US006065289A

United States Patent [19]

Phillips

[11] Patent Number: 6,065,289

[45] Date of Patent: May 23, 2000

[54] FLUID DISPLACEMENT APPARATUS AND METHOD

[75] Inventor: Darryl H. Phillips, Sallisaw, Okla.

[73] Assignee: Quiet Revolution Motor Company, L.L.C., Sallisaw, Okla.

[21] Appl. No.: 09/103,943

[22] Filed: Jun. 24, 1998

[51] Int. Cl.[7] ..... F01B 19/02; F02G 1/044

[52] U.S. Cl. ..... 60/525; 60/517; 60/581; 92/89; 418/61.1; 418/62

[58] Field of Search ..... 418/15, 61.1, 62, 418/150, 156, 209, 253, 270; 92/89; 60/486, 581, 517, 525

[56] References Cited

U.S. PATENT DOCUMENTS

| | | | |
|---|---|---|---|
| 348,217 | 8/1886 | Isbell | 418/62 |
| 631,701 | 8/1899 | Du Bois | 418/61.1 |
| 696,767 | 4/1902 | Sleeper | 92/89 |
| 745,820 | 12/1903 | Greene . | |
| 753,790 | 3/1904 | Ford . | |
| 776,431 | 11/1904 | Severance . | |
| 856,102 | 5/1907 | Ringbom . | |
| 1,023,195 | 4/1912 | Bourlon . | |
| 1,028,371 | 5/1912 | Madero . | |
| 1,033,514 | 7/1912 | Alford . | |
| 1,070,588 | 8/1913 | Darlington . | |
| 1,138,215 | 5/1915 | Harford . | |
| 1,197,578 | 9/1916 | Jackson | 418/61.1 |
| 1,197,579 | 9/1916 | Jackson | 418/146 |
| 1,220,594 | 3/1917 | Betzle . | |
| 1,241,755 | 10/1917 | Nearing . | |
| 1,262,164 | 4/1918 | Bertsch . | |
| 1,279,913 | 9/1918 | Roberts . | |
| 1,345,526 | 7/1920 | Adams . | |
| 1,473,249 | 11/1923 | O'Rourke . | |
| 1,903,721 | 4/1933 | Munn | 418/61.1 |
| 2,137,172 | 11/1938 | Mabille . | |
| 2,139,856 | 12/1938 | Savage . | |
| 2,464,208 | 3/1949 | Bolster | 418/61.1 |
| 2,717,555 | 9/1955 | Hinckley . | |
| 2,957,429 | 10/1960 | Fisk . | |
| 2,974,644 | 3/1961 | Celovsky | 121/75 |
| 3,240,157 | 3/1966 | Hinckley . | |
| 3,525,215 | 8/1970 | Conrad | 60/19 |
| 3,557,661 | 1/1971 | Orshansky, Jr. | 91/184 |
| 3,574,494 | 4/1971 | Bellmer | 418/270 |
| 3,606,605 | 9/1971 | Ostwald | 418/253 |
| 3,614,277 | 10/1971 | Kobayashi | 418/253 |
| 3,673,927 | 7/1972 | Fluhr | 92/98 |
| 3,821,899 | 7/1974 | Granberg | 73/260 |
| 4,011,033 | 3/1977 | Christy | 418/253 |
| 4,061,450 | 12/1977 | Christy | 418/253 |
| 4,181,481 | 1/1980 | Jordan | 418/253 |
| 4,186,613 | 2/1980 | Carlson, Jr. | 74/52 |
| 4,474,105 | 10/1984 | Eicher et al. | 92/122 |
| 4,646,568 | 3/1987 | Lew | 73/260 |

(List continued on next page.)

FOREIGN PATENT DOCUMENTS

| | | | |
|---|---|---|---|
| 776645 | 11/1934 | France | 60/581 |

OTHER PUBLICATIONS

Phillips "Putting the Aircraft Stirling Together", *Stirling Machine World,* pp. 4–10, Mar. 1994.

Phillips "Aviation is Overdue for Fresh Approach to Powerplant Design", *TBO Advisor,* pp. 9–11, Nov.–Dec., 1996.

Phillips "Harnessing the Stirling Engine's Potential", *TBO Advisor,* pp. 8–10, Jan.–Feb., 1997.

*Primary Examiner*—John J. Vrablik

*Attorney, Agent, or Firm*—Fellers, Snider, Blankenship, Bailey & Tippens

[57] ABSTRACT

The present invention relates generally to fluid displacement apparatuses and methods. The inventive apparatus comprises: a housing having an interior space; a crankpin positionable in the interior space; and a plurality of articulated displacement members positionable in the interior space such that the articulated displacement members extend from the crankpin and define in the interior space a plurality of displacement zones. The inventive apparatus can be embodied as a pump, a compressor, a fluid flow meter, a stirling-type engine, a relay system, an actuator, and many other devices.

26 Claims, 21 Drawing Sheets

U.S. PATENT DOCUMENTS

| | | | |
|---|---|---|---|
| 4,711,620 | 12/1987 | Takahashi et al. | 418/96 |
| 4,774,875 | 10/1988 | Amshoff, III | 92/122 |
| 4,830,593 | 5/1989 | Byram et al. | 418/253 |
| 4,846,638 | 7/1989 | Pahl et al. | 418/39 |
| 4,990,074 | 2/1991 | Nakagawa | 418/172 |
| 5,051,059 | 9/1991 | Rademacher | 415/7 |
| 5,077,976 | 1/1992 | Pusic et al. | 60/525 |
| 5,098,264 | 3/1992 | Lew | 418/510 |
| 5,107,754 | 4/1992 | Nishikawa et al. | 91/530 |
| 5,131,270 | 7/1992 | Lew | 73/259 |
| 5,163,825 | 11/1992 | Oetting | 418/153 |
| 5,177,968 | 1/1993 | Fellows | 60/525 |
| 5,181,843 | 1/1993 | Hekman et al. | 418/1 |
| 5,188,524 | 2/1993 | Bassine | 418/152 |
| 5,299,922 | 4/1994 | Moody | 418/45 |
| 5,431,015 | 7/1995 | Hein et al. | 60/581 |
| 5,440,926 | 8/1995 | Lew et al. | 73/259 |
| 5,466,135 | 11/1995 | Draskovits et al. | 418/268 |
| 5,571,005 | 11/1996 | Stoll et al. | 418/268 |
| 5,697,773 | 12/1997 | Mendoza et al. . | |

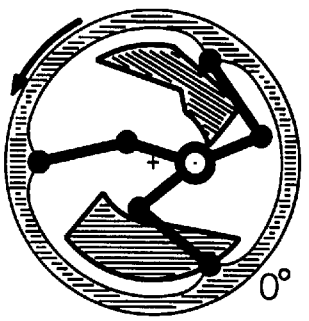
Fig. 13A
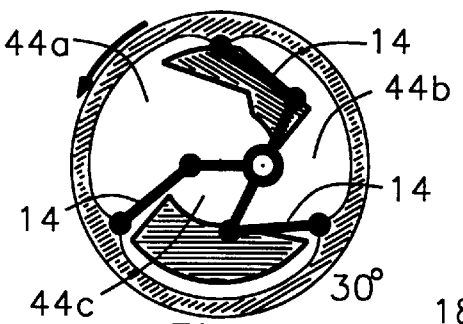
Fig. 13B
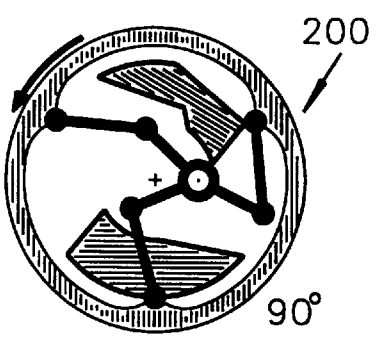
Fig. 13C
Fig. 13D
Fig. 13E
Fig. 13F
Fig. 13G
Fig. 13H
Fig. 13I
Fig. 13J
Fig. 13K
Fig. 13L

FLUID DISPLACEMENT APPARATUS AND METHOD

FIELD OF THE INVENTION

The present invention relates to fluid displacement apparatuses and to methods employing such apparatuses.

BACKGROUND OF THE INVENTION

Various vane-type fluid displacement apparatuses have been proposed for use in certain limited applications. These proposed devices have primarily consisted of pumps, compressors, fluid driven motors, and fluid flow meters. Even in these limited applications, however, the vane-type apparatuses heretofore proposed have generally not performed satisfactorily and therefore have not gained significant acceptance. Common difficulties encountered with prior art vane-type apparatuses have included: an unsuitability for use with friction-reducing devices, which has traditionally limited their use to moderate power levels; a large fixed-surface to moving-surface contact area, resulting in high friction; an inability to withstand bending forces applied to the crankshaft; a reliance on discrete check valves or the like; and an inability to accommodate simultaneous reciprocating flow from each individual chamber.

U.S. Pat. No. 3,821,899 teaches a vane-type meter for use with petroleum or other fluid products. Its structure comprises: a housing having an inlet port and an outlet port; a rotating interior disc; an interior shaft held with respect to the rotating disk in a fixed, eccentric position with respect to the rotating disc; four radially extending, articulated vanes which rotate within the housing about the interior shaft; and four valving structures extending perpendicularly from the outer periphery of one side of the rotating disc. Each of the vanes includes an inner vane element consisting of: a substantially flat body; a single closed ring which extends from one end of the body and is rotatably positioned around the interior shaft; and an elongate, open C-shaped groove extending along the opposite end of the body. Each articulated vane also includes an outer vane element consisting of: a substantially flat body; an elongate pentil structure is formed along one end of the body and pivotably held in the C-shaped groove formed on the inner member; and a second elongate pentil structure formed along the other end of the body. The second pentil structure is pivotably held in one of the valving structures.

Fluid flow through the meter of U.S. Pat. No. 3,821,899 causes the disc, valving ports, and articulated vanes to rotate within the meter housing. As they rotate, the vanes form compartments which change in volume and through which known amounts of liquid are transferred from the inlet to the outlet of the device. Thus, the rotational speed of the device provides a direct indication of the fluid flow rate.

U.S. Pat. No. 2,139,856 discloses a pump or fluid-driven engine employing articulated vanes having shaped outer surfaces. The vanes form fluid chambers which continuously change in volume.

In one embodiment, the apparatus of U.S. Pat. No. 2,139,856 comprises: a housing; a cylindrical casing held in fixed position within the housing; a crankpin mounted in the casing for eccentric revolving movement; eight articulated, two-part vanes, each having an inner end pivotably connected to the crankpin and an outer end pivotably connected to the casing; eight flow ports provided through a sidewall of the displacement chamber; a flow chamber provided between the casing and the housing; and eight flow ports and associated check valves provided in the casing between the outer ends of the vanes.

In a second embodiment of the device of U.S. Pat. No. 2,139,856, the crankpin is held at a fixed eccentric position within the casing and the casing rotates within the housing. As the casing rotates about the eccentrically positioned crankpin, the compartments formed by the articulated vanes successively draw fluid from inlet ports formed through one of the flat sidewalls of the displacement chamber, and then discharge the fluid through one or more fixed ports in the housing. Each of the articulated vanes has either one or two closed rings formed on the inner end thereof. These inner closed rings are rotatably positioned around the crankpin.

Devices such as those proposed by U.S. Pat. No. 2,139,856 and U.S. Pat. No. 3,821,899 have several shortcomings. First, the devices fail to provide any adequate means for reducing frictional forces generated within the moving articulated vane assemblies. Additionally, the cost and complexity of the devices is significantly increased by the required use of completely separate fluid intake and discharge valve systems and/or port structures. Further, the devices provide no means for creating, accessing, and utilizing reciprocating flow regimes between adjacent pairs of articulate vanes. Also, the devices disclose no means for selectively configuring the vanes and displacement chambers in order to obtain specific desired flow patterns. Additionally, these designs have large and significant areas of metal-to-metal sliding contact with no means shown for reducing friction between the parts. (Consider, for example, the potential for friction to be generated between parts 15 and 24 in the Savage (U.S. Pat. No. 2,139,856) device; and between parts 18 and 42 in the Granberg (U.S. Pat. No. 3,821,899) patent. Finally, neither of these devices provide for bi-directional flow simultaneously from the various chambers.

A need also presently exists for a new or significantly improved power plant for light aircraft. Engine systems currently employed in such applications are expensive to manufacture, maintain, and overhaul, and produce excessive noise and vibration. Moreover, the existing systems are greatly inefficient and lose power at altitude. These efficiency and power problems lead to increased engine weight, increased drag, reduced available range and payload capacity, reduced air speed, reduced climb rate, and reduced aircraft ceiling. Broadly speaking, the stirling thermodynamic cycle offers at least a partial solution to the above problems. However, a conventional stirling engine suffers from a number of heretofore insurmountable problems, included among which is the difficulty in achieving an acceptable power to weight ratio—a difficulty which is due in part to the need for an improved means of coupling the pistons to the crankshaft.

Thus, what is needed is a vane-type device that experiences reduced frictional forces within its articulated vane assemblies. Additionally, the device should be one that can be assembled, operated, and maintained cost effectively. Further, the device should be capable of generating or responding to reciprocating flow during its operation. Even further, the vanes of the device should be configurable so that specific flow patterns can be obtained. Also, the vanes of the device should be positionable to reduce bending moment on the crankshaft. Additionally, the device should be one that, if used as an engine, is more fuel efficient and produces less noise and vibration during operation. Finally, the device, if used within an aircraft engine, should result in an engine that is less susceptible than conventional aircraft engines to power loss at altitude.

Before proceeding to a description of the instant invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

The present invention satisfies the needs and alleviates the problems of the prior art discussed above. According to one embodiment, the present invention provides a near-silent, light weight, and substantially vibration-free engine which has almost twice the fuel efficiency of existing light aircraft engines and which does not lose power at altitude and does not limit the aircraft ceiling. The present invention also provides novel and inventive pumps, compressors, flow meters, relay systems, actuators, motors, and other devices that utilize the same device as their core operative element.

According to one aspect of the instant invention, there is provided an apparatus for displacing fluid volumes comprising: a housing having an interior space; a revolving structure positionable in the interior space for a circuitous revolving movement; and a plurality of articulated displacement members positionable in the interior space and defining therein a plurality of displacement zones. Each of the displacement zones has a flow opening through which the fluid alternately enters and exists: a bi-directional flow cycle. Each of the articulated displacement members has an inner end portion, pivotably mounted on the revolving structure, and an outer portion, pivotably securable in the housing at a substantially fixed position. Further, each of the displacement zones has a maximum and a minimum volume. During operations, the articulate displacement members are operable for cycling the displacement zones to and from these maximum and minimum volumes.

According to another aspect, the present invention provides a method of actuating a separate—possibly remote—device. This inventive method comprises the step of operably linking the instant device to one of the displacement zones of the above-described inventive fluid displacement apparatus.

In still another aspect, the present invention provides a fluid displacement apparatus comprising: a housing having an interior space; an interior base structure operably positionable in the interior space; and a plurality of articulated displacement members positionable in the interior space such that the articulated displacement members extend from the base structure and define in the interior space a plurality of displacement zones. This apparatus further comprises a fluid port operably positionable in the housing for revolving movement such that the port is sequentially placed in fluid communication with each of the displacement zones.

In a further aspect, the present invention provides an apparatus for relaying indicia of movement between two remotely positioned devices which are interconnected by hydraulic lines. The inventive relaying apparatus comprises a first fluid displacement device and a second fluid displacement device. Each of the displacement devices comprises: a housing having an interior space; an interior base structure positionable in the interior space and a plurality of displacement members positionable in the interior space such that the displacement members extend from the base structure and define in the interior space a plurality of displacement zones. Each of the first and second fluid displacement devices has at least a first displacement zone and a second displacement zone. The inventive relaying apparatus further comprises a first communication means for placing the first displacement zone of the first fluid displacement device in effective fluid communication with the first displacement zone of the second fluid displacement device. The inventive relaying device also comprises a second communication means for placing the second displacement zone of the first fluid displacement device in effective fluid communication with the second displacement zone of the second fluid displacement device.

In yet another aspect, the present invention provides a fluid displacement apparatus comprising: a housing having an interior space; a base pin eccentrically positionable in the housing; and a plurality of articulated displacement members positionable in the interior space and defining in the interior space a plurality of displacement zones. Each of the articulated displacement members comprises: a proximal member having a plurality of closed first hinge rings and a plurality of closed second hinge rings; a distal member having a plurality of closed third hinge rings and a plurality of fourth hinge rings; a hinge pin for said second and third hinge rings; fifth hinge rings fixedly mounted on, or a part of, said housing; and a hinge pin for said fourth and fifth hinge rings. The second and third hinge rings are mountable on their hinge pin in an intermeshing manner. The first hinge rings of the plurality of articulated displacement members are positionable on the base pin in an intermeshing manner. The fourth and fifth hinge rings are mountable on their hinge pin in an intermeshing manner.

In yet another aspect of the instant invention there is provided a method of modifying the relative lengths and other parameters related to the articulated displacement members discussed previously so as to obtain a desired symmetric or asymmetric duty cycle. Additionally, the volume of fluid displaced during each cycle can be similarly adjusted through variation of these same parameters.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

FIGS. 13A–L illustrates the operation, in 30° increments, of a Type B embodiment 200 of the inventive apparatus.

DESCRIPTION OF THE PREFERRED EMBODIMENTS

Figure 1:
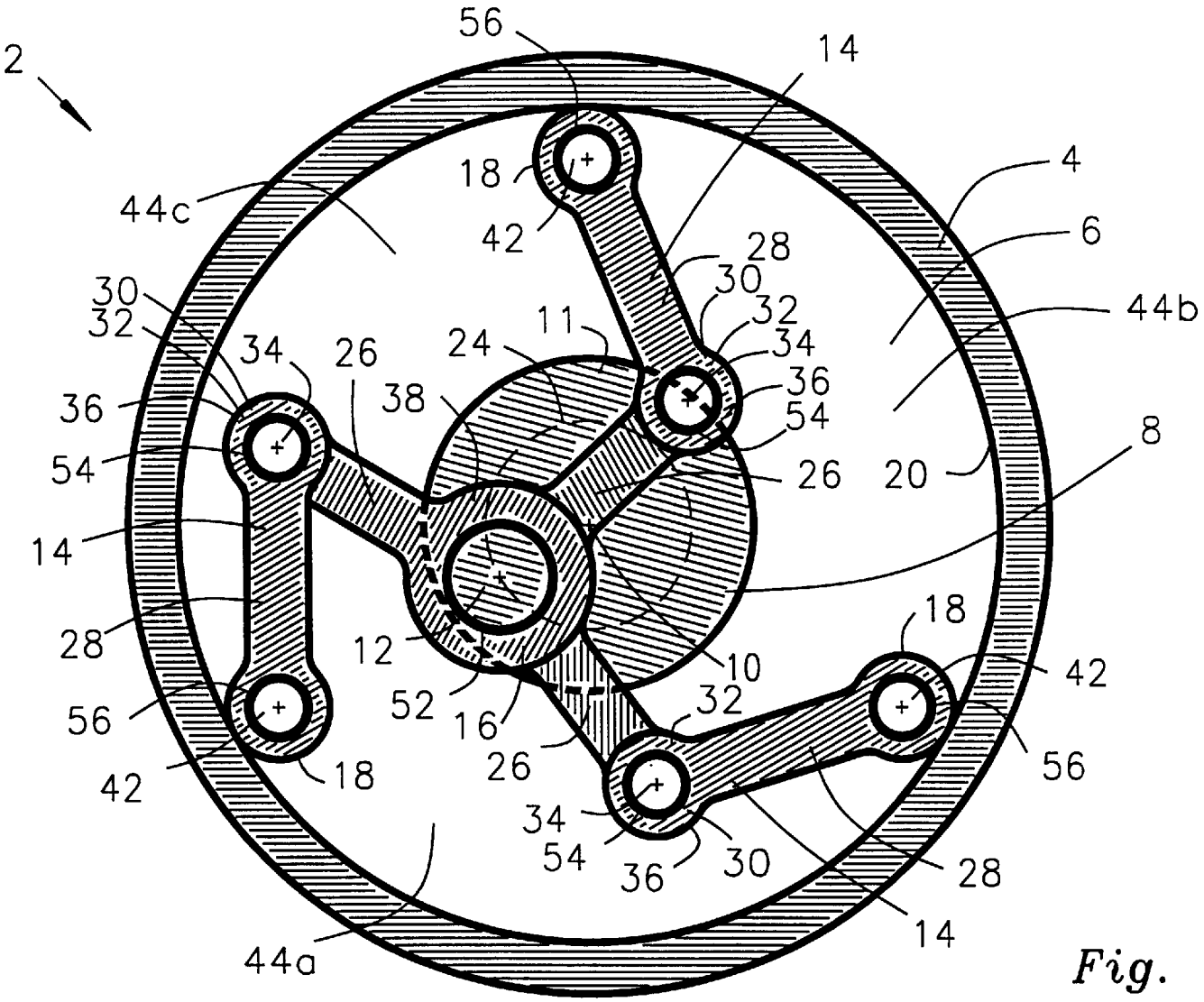
FIG. 1 provides an end view of a Type A embodiment 2 of the inventive apparatus.

A displacement system 2 provided by the present invention (hereinafter referred to as a Type A system) is depicted in FIGS. 1, 2, 3A–F, and 4. As is best illustrated in FIG. 1, the principal elements of the Type A system are a housing 4 having an interior 6; a crank assembly 8 having a longitudinal axis of rotation 10 and including a cylindrical crankpin 12 which extends into the interior 6 of housing 4; and a plurality of articulated displacement members 14, each having a proximal end 16 pivotably mounted on crankpin 12 and a distal end 18 which is pivotably mounted in fixed position within housing 4. The distal ends 18 of the displacement members 14 are preferably uniformly spaced within housing 4 and are pivotably positioned adjacent to the interior wall 20 of housing 4 such that they effectively seal against interior wall 20.

Figure 2:
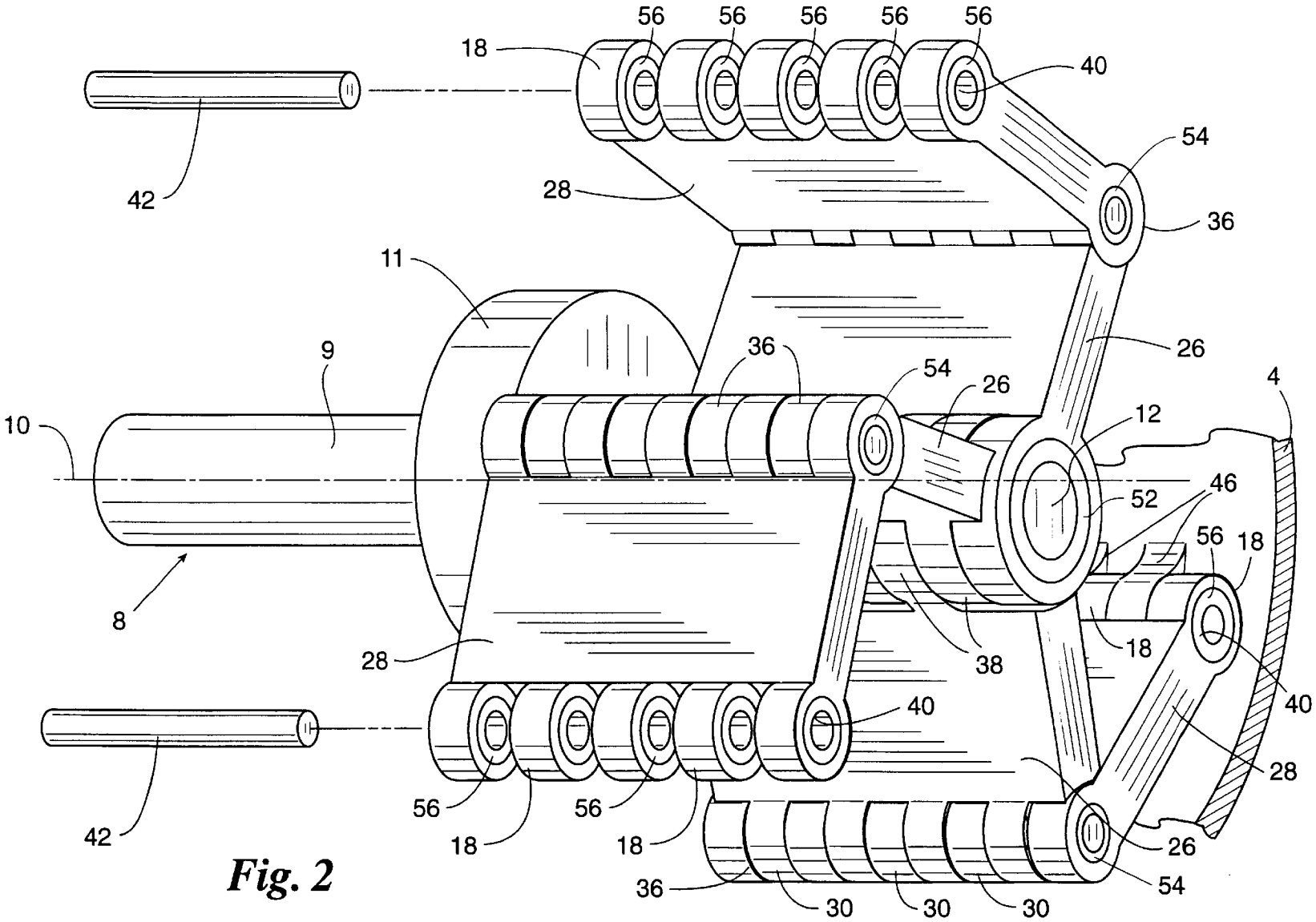
FIG. 2 provides a perspective view of a crank and vane assembly used in the inventive apparatus.
Figure 3A:
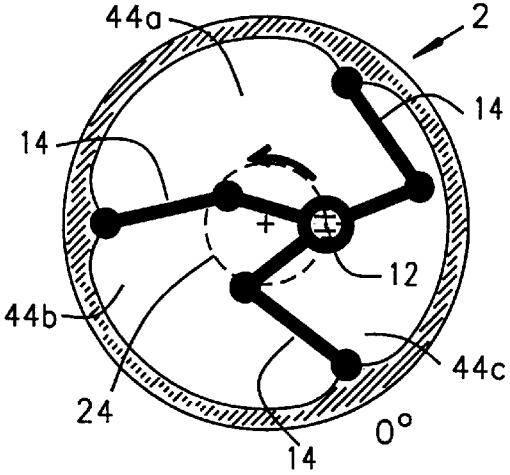
FIGS. 3A–F illustrate the operation of apparatus 2 in 60° increments of a complete 360° cycle.
Figure 3B:
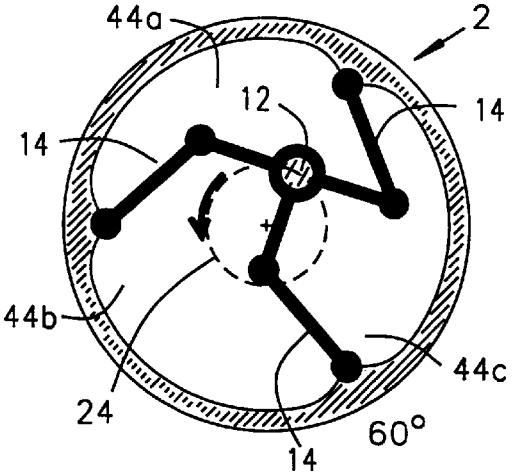
Figure 3C:
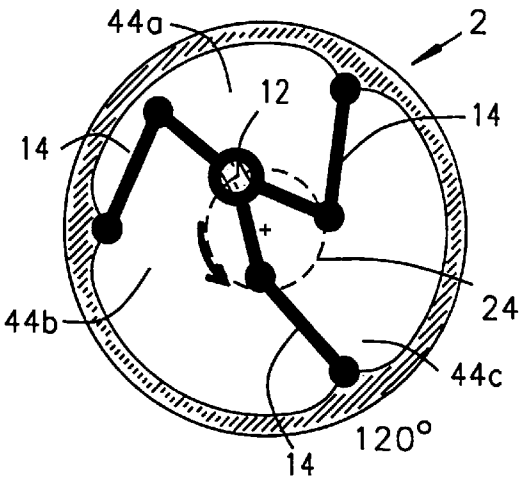
Figure 3D:
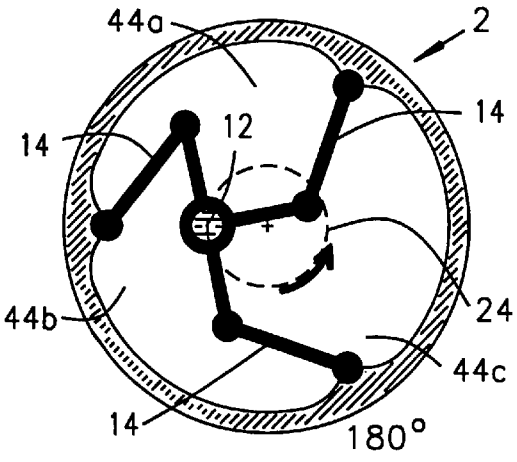
Figure 3E:
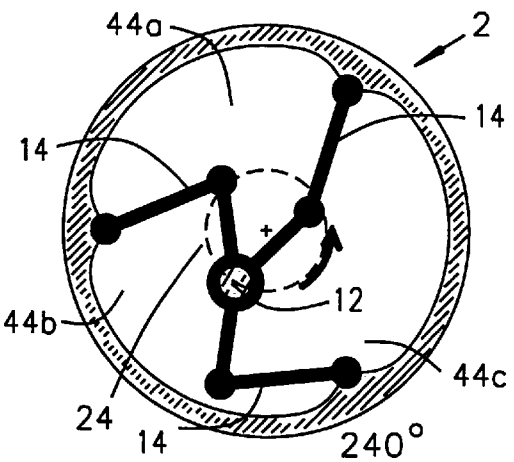
Figure 3F:
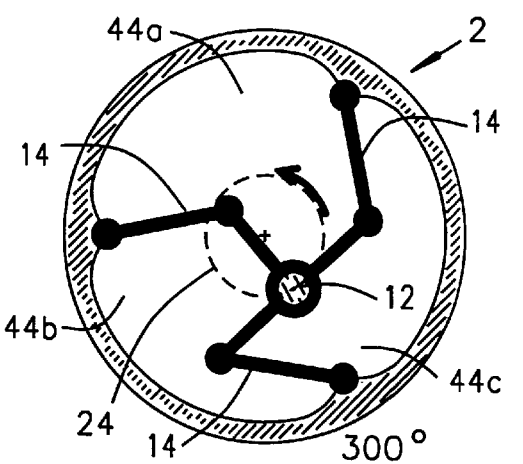
Figure 4:
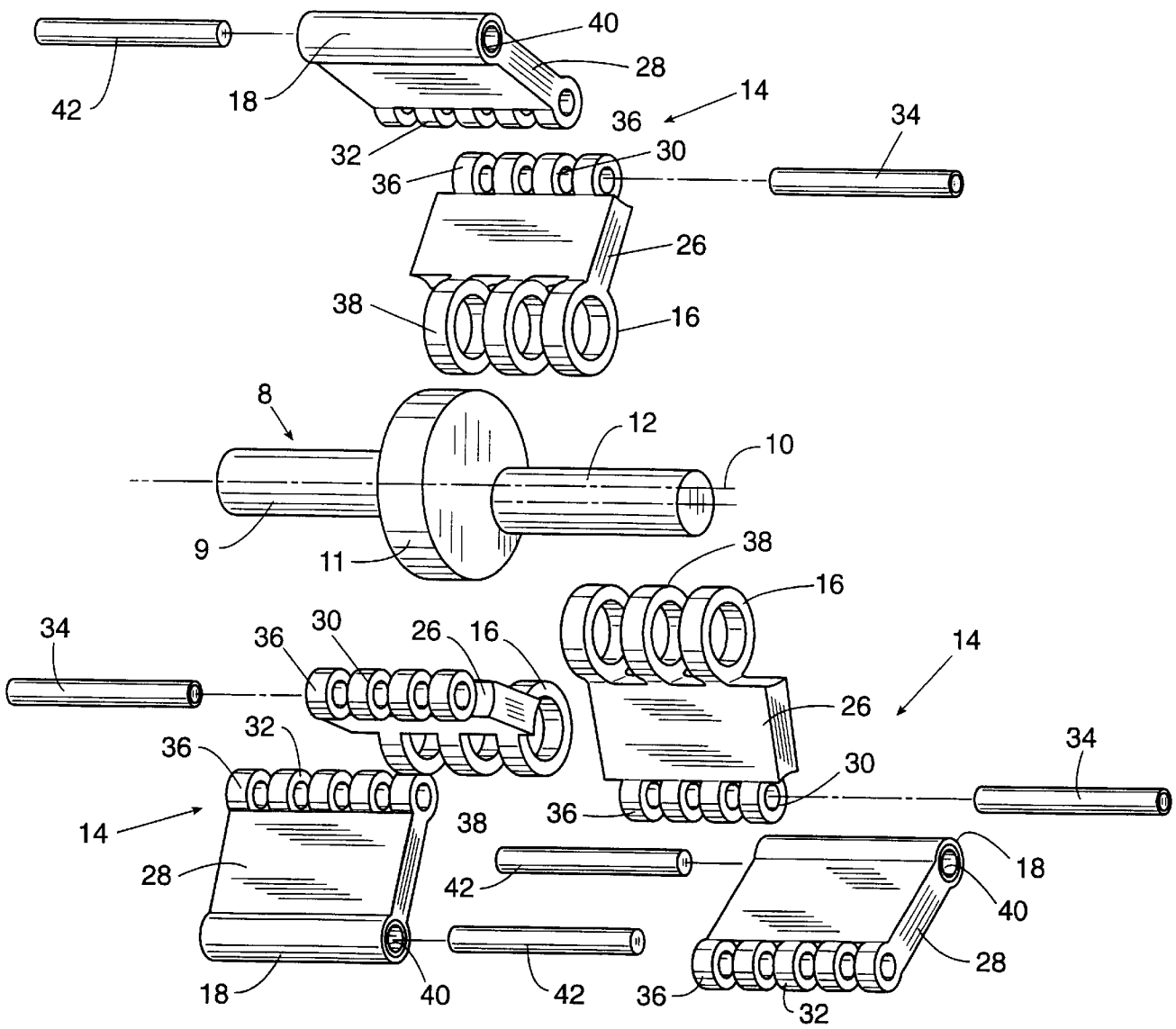
FIG. 4 provides an exploded perspective view of the crank and vane assembly.
Figures 5A, 5B, 5C, 5D, 5E, 5F:
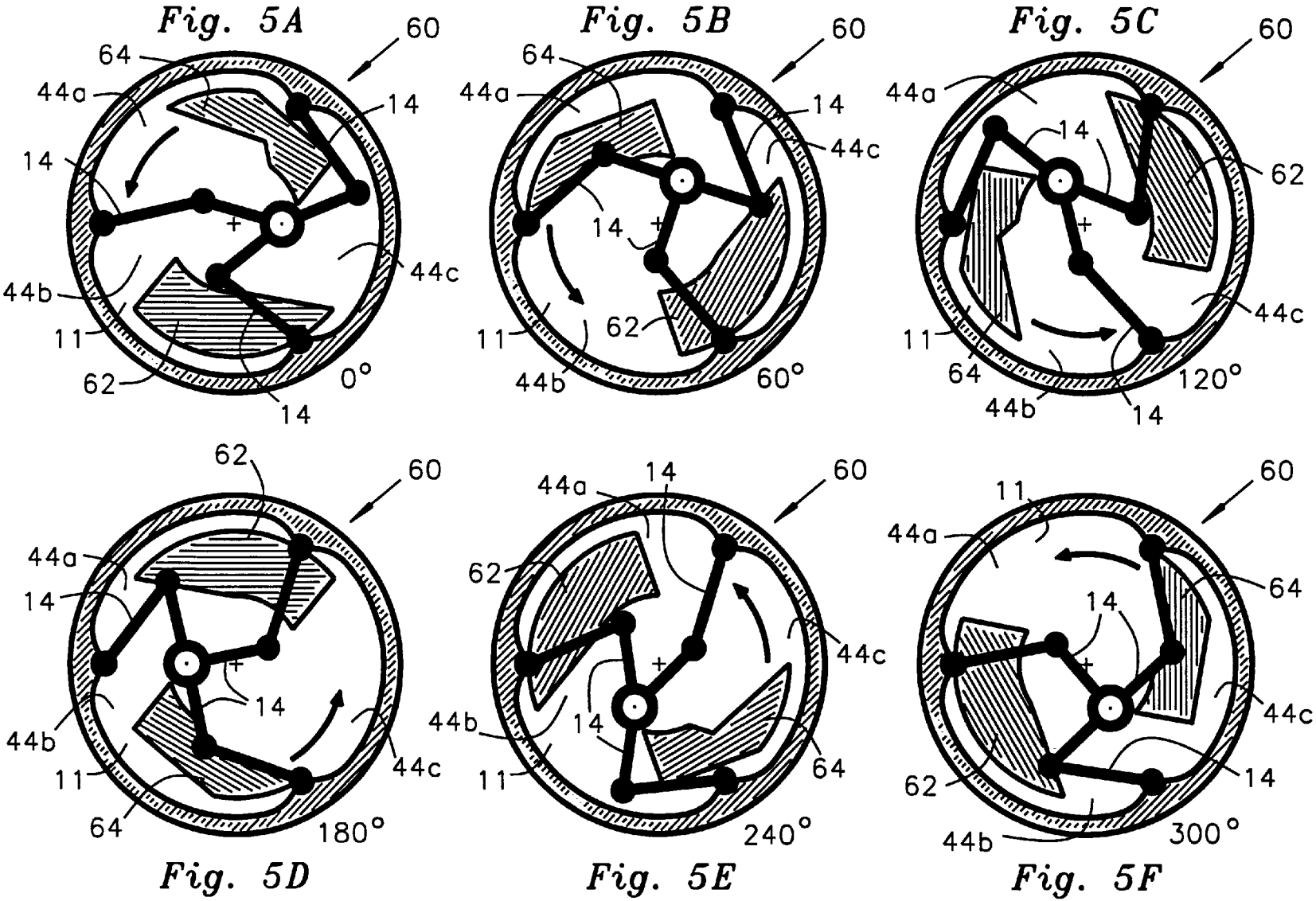
FIGS. 5A–F illustrates the operation in 60° increments of a Type A embodiment 60 of the inventive apparatus.

Turning now to FIG. 2, the crank assembly 8 includes a crankshaft 9 and a circular plate 11 concentrically formed or attached on the end of crankshaft 9. Crankpin 12 is eccentrically positioned on crankshaft plate 11, which positioning is an important aspect of the instant invention. Thus, as the crank assembly rotates about axis 10, crankpin 12 revolves in a circular orbit 24 within housing 4. The proximal ends 16 of displacement members 14 are pivotably mounted on crankpin 12 such that proximal ends 16 move with crankpin 12 along orbit 24.

Each of articulated displacement members 14 is preferably an articulated vane assembly comprising an inner vane element 26 and an outer vane element 28. The distal end 30 of inner element 26 and the proximal end 32 of outer element 28 are pivotably hinged together by an elongate hinge pin 34. The distal end 30 of inner element 26 and the proximal end 32 of outer element 28 preferably each have a plurality of (preferably at least 3) closed hinge rings 36 formed thereon in a spaced arrangement such that the rings 36 intermesh around hinge pin 34 in the manner shown in FIG. 2. Similarly, the proximal end 16 of each articulated displacement member 14 has a plurality of (preferably at least three) closed hinge rings 38 formed thereon such that, when mounted on crankpin 12, all of the hinge rings 38 of displacement members 14 intermesh in the manner depicted in FIG. 2. The distal ends 18 of articulated members 14 preferably have closed hinge rings 40 which intermesh with hinge rings 46 which are a part of housing 4.

The articulated displacement members 14 effectively divide the interior 6 of housing 4 into a plurality of displacement zones 44. When three displacement members 14 are used—as is depicted in FIGS. 1–4—the displacement members form three separate displacement zones 44*a*, 44*b*, and 44*c* (FIG. 1). Each of the displacement zones 44 has a minimum and a maximum volume depending on the position of the crankpin 12. As the proximal ends 16 of articulated displacement members 14 travel around circular orbit 24, the members flex at pivot points 12, 34, and 42 such that displacement members 14 cycle the displacement zones 44 to and from their maximum and minimum volumes. For each revolution of crankpin 12, each of displacement zones 44 achieves one maximum volume configuration and one minimum volume configuration.

FIGS. 3A–F depict the changing configurations of displacement zones 44 as crankpin 12 moves around one complete orbit 24. FIGS. 3A–3F illustrate the complete 360° orbit 24 in 60° increments. In general operation, as each displacement zone 44 moves toward its maximum volume, a fluid (i.e., a liquid, a gas, a slurry, an emulsion, or any other fluid material) moves into the zone 44. Then, as the displacement zone 44 moves toward its minimum volume, fluid moves out of the displacement zone 44.

The inventive apparatus disclosed herein also includes a novel friction reduction system. The principal elements of this system include first friction reducing elements 52, positioned within hinge rings 38, for reducing frictional forces generated by the rotation of the crankpin 12 within hinge rings 38; second friction reducing elements 54 for reducing the frictional forces generated by the pivoting movement of closed hinge rings 36 on hinge pins 34; and third friction reducing elements 56 positioned within bores 40 for reducing the frictional forces generated by the pivoting movement of closed bores 40 on posts 42. First friction reducing element 52 is preferably a rolling element bearing. Second friction reducing elements 54, and third friction reducing elements 56, are preferably formed from a thermoplastic alloy with a fiber matrix, impregnated with solid lubricant such as PTFE, but may also be bronze bushings or the like.

One variation 60 of the inventive Type A system 2 is depicted in FIGS. 5A–F. In variation 60, circular crank plate 11 extends across the entire cross section of housing interior 6 and has both a fluid inlet port 62 and a fluid outlet port 64 formed therethrough. As illustrated in FIGS. 5A–F, plate 11 and ports 62 and 64 revolve with crankpin 12 such that each of the ports 62 and 64 moves sequentially into fluid communication with each of displacement zones 44*a*, 44*b*, and 44*c*. Inlet port 62 is positioned in plate 11 so as to move into fluid communication with each displacement zone 44 as the displacement zone 44 moves toward its maximum volume. Outlet port 64 is positioned in plate 11 so as to move into fluid communication with each displacement zone 44 as the displacement zone 44 moves toward its minimum volume.

Figure 6:
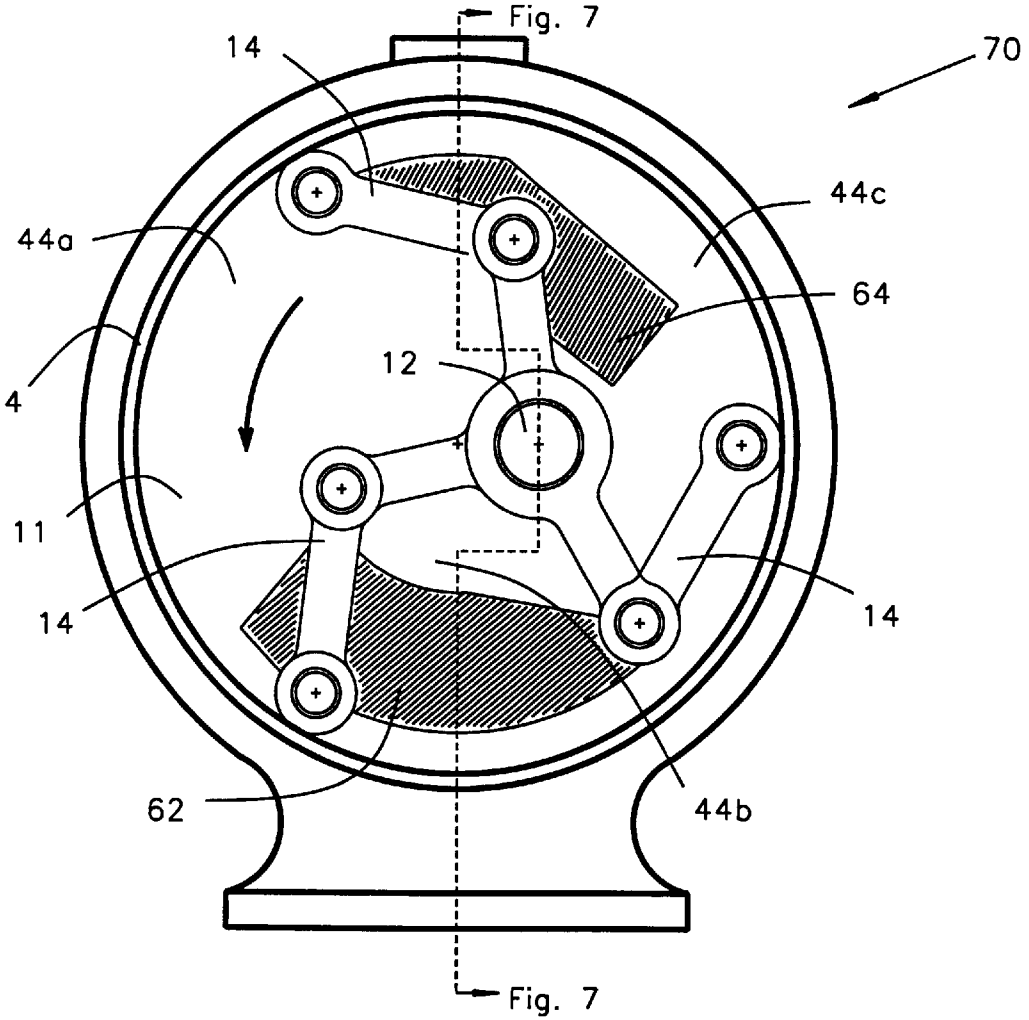
FIG. 6 provides a cutaway elevational end view of embodiment 70.
Figure 7:
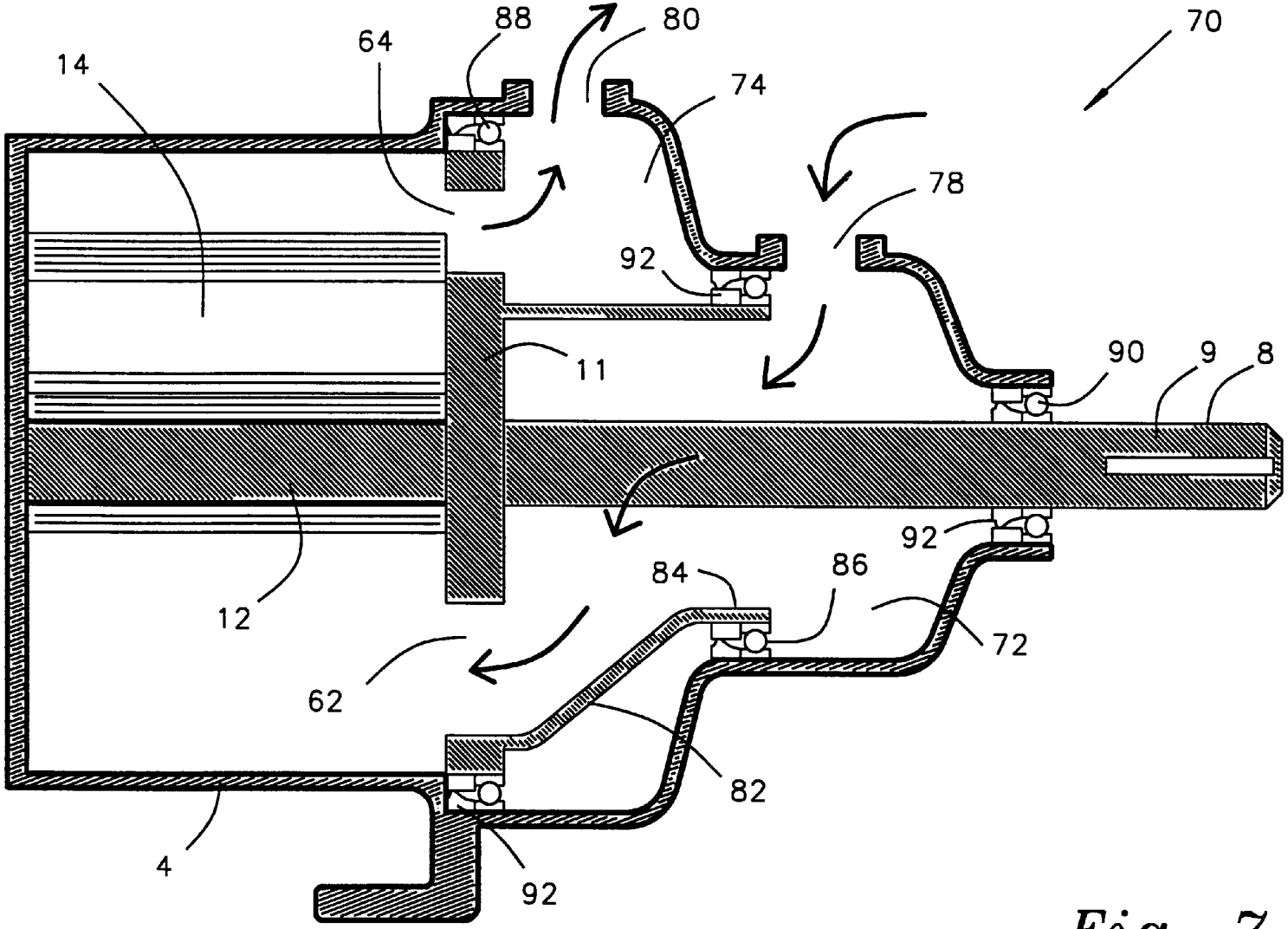
FIG. 7 provides a cutaway elevational side view of embodiment 70.

An additional embodiment 70 of Type A variation 60 is depicted in FIGS. 6 and 7. In addition to the features discussed previously, embodiment 70 includes a housing 4 having an inner fluid chamber 72, an outer fluid chamber 74, a housing inlet port 78 through which fluid enters inner fluid chamber 72; and a housing outlet port 80 through which fluid is delivered from outer fluid chamber 74. As plate 11 revolves in housing 4, the inlet port 62 formed therein remains in fluid communication with inner fluid chamber 72 and the plate outlet port 64 remains in fluid communication with outer fluid chamber 74. A shaped throat piece 82 extends rearwardly from, and rotates with, circular plate 11. Throat piece 82 separates and isolates inner fluid chamber 72 from outer fluid chamber 74 such that inlet fluid flow travels through the interior of throat piece 82 and outlet fluid flow travels over the exterior of throat piece 82.

Throat piece 82 has a cylindrical rearward end 84 which rotates within a bearing, bushing, or other friction reducing element 86. Circular plate 11 rotates within a bearing, bushing or other friction reducing element 88. Crank assembly 8 extends through inner fluid chamber 72 and rotates within a bearing, bushing, or other friction-reducing element 90. Lip seals or other types of sealing devices 92 are provided adjacent friction reducing elements 86, 88, and 90 for preventing fluid leakage to and from fluid chambers 72 and 74 and displacement zones 44.

As will be apparent to those skilled in the art, Type A apparatus 70 can be employed as a pump, a compressor, or similar fluid transfer device by using a motor or other drive system to rotate crank assembly 8. On the other hand, by driving, directing, or otherwise conducting a fluid through apparatus 70, inventive apparatus 70 can be employed as a fluid-driven motor, a flow meter, or similar device.

Figure 8:
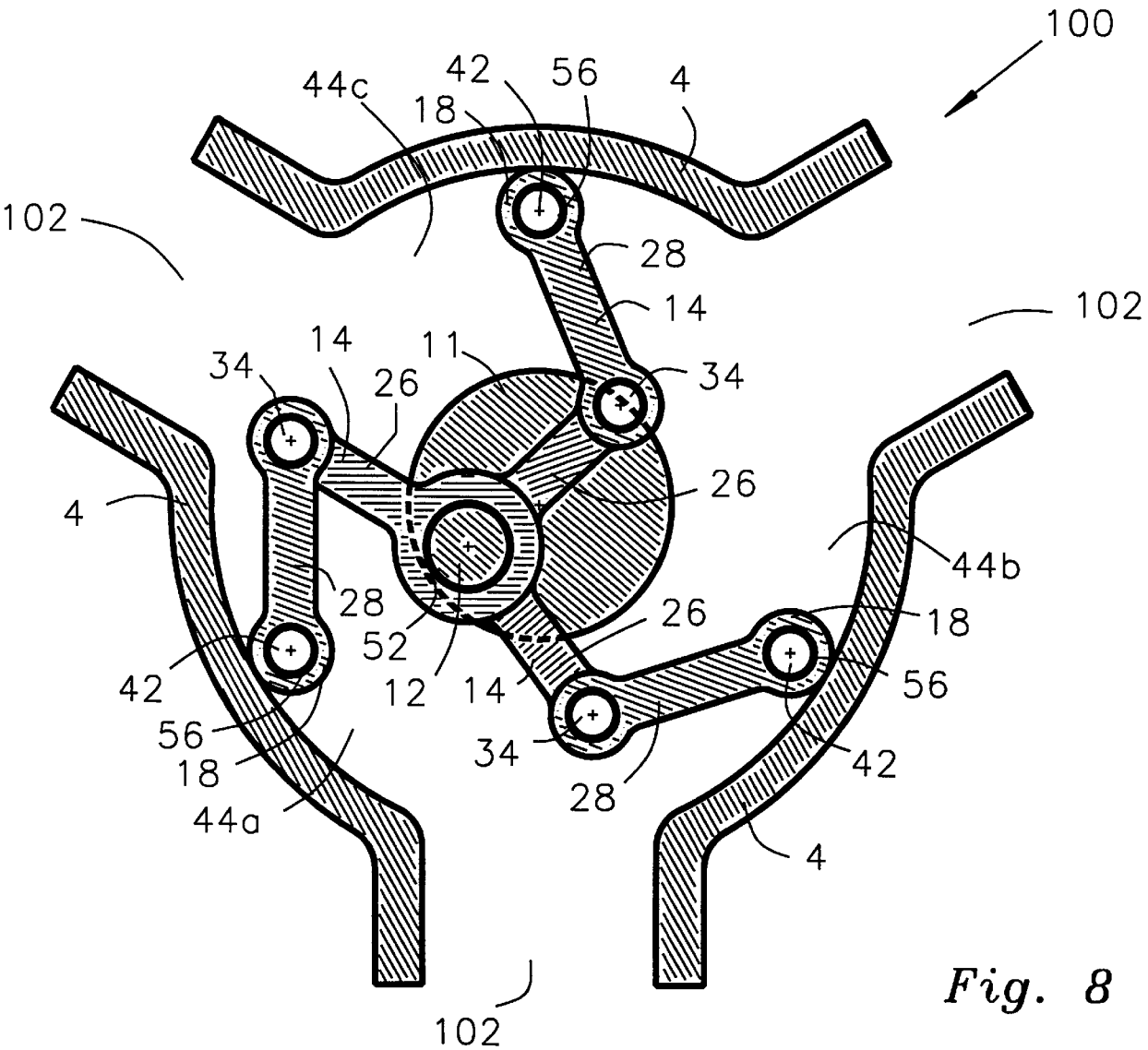
FIG. 8 provides an end view of a Type A embodiment 100 of the inventive apparatus.

Another variation 100 of Type A system 2 is depicted in FIG. 8. Variation 100 is substantially identical to the embodiment 2 shown in FIG. 1, except that each displacement zone 44 includes a single port 102 through which fluid both enters and exits displacement zone 44. Ports 102 preferably extend through housing 4. Displacement zones 44 are preferably isolated from each other such that an independent, bi-directional flow cycle is provided by each of zones 44. As each displacement zone 44 moves toward its maximum volume, fluid flows into the displacement zone through its associated port 102. Then, as the displacement zone 44 moves toward its minimum volume, the fluid flows out of the displacement zone through the associated port 102.

Variation 100 of the inventive Type A system has numerous novel and useful applications. By employing reed valves or other check valves, each displacement zone of device 100 can be used as a reciprocating-type pump, compressor or other such apparatus. As explained hereinafter, device 100 can also be used to form an inventive relay system and as an inventive stirling-type engine.

Figure 9:
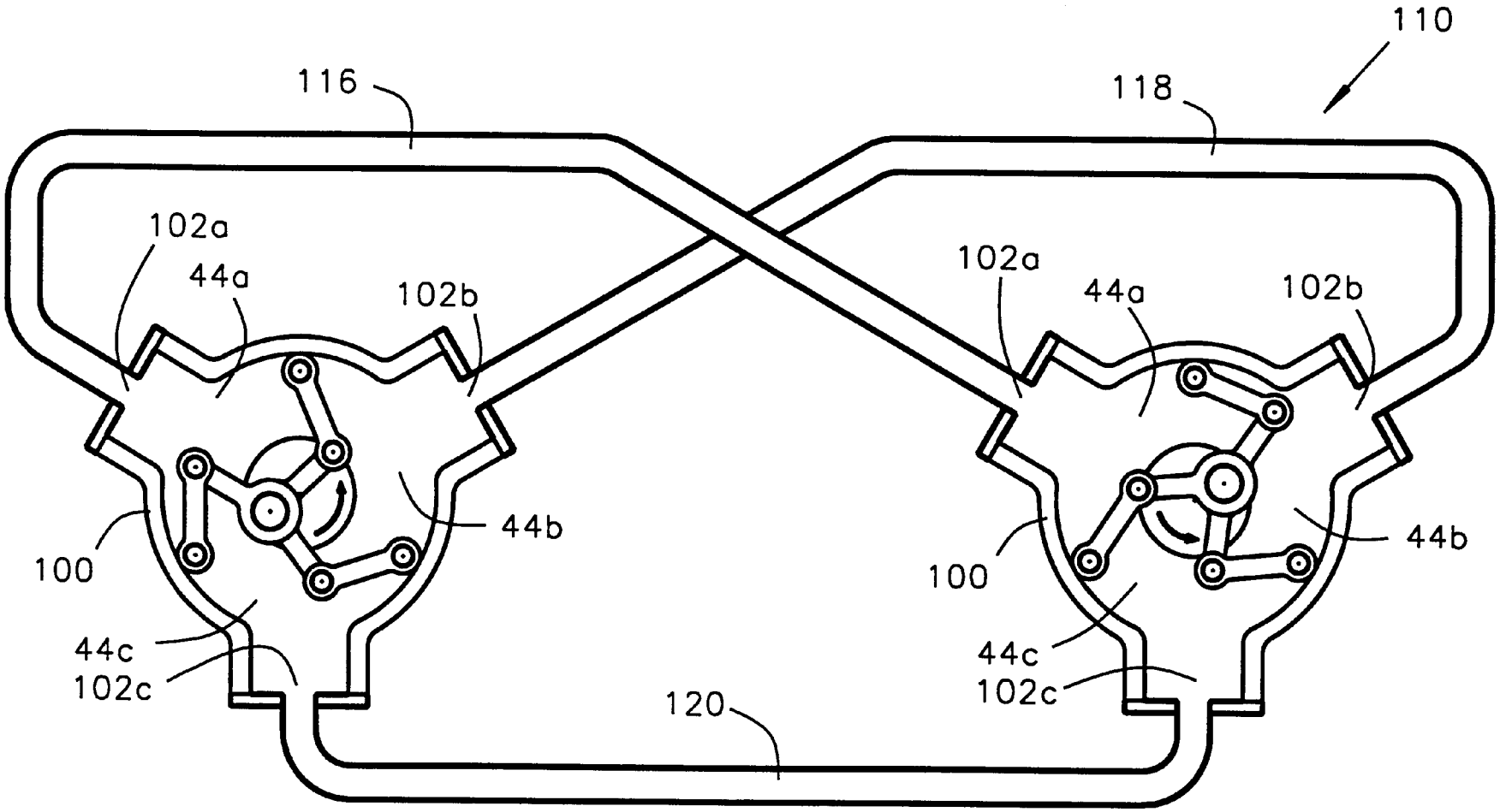
FIG. 9 schematically illustrates an embodiment 110 of a relay system provided by the present invention.

An embodiment 110 of the inventive relay system is depicted in FIG. 9. Relay system 110 employs two Type A devices 100. The two Type A devices 100 preferably have an equal number of displacement zones 44. Each of the Type A devices 100 is preferably of a type having at least three displacement zones 44*a*, 44*b*, and 44*c*. Relay system 110 further includes the following elements: a first pipe, flexible hose, or other conduit 116 extending between ports 102*a* of the displacement devices 100; a pipe, flexible hose, or other conduit 118 extending between ports 102*b* of devices 100; and a pipe, flexible hose, or other conduit 120 extending between ports 102*c* of devices 100. Conduits 116, 118 and 120 are preferably filled with fluid and place corresponding pairs of individual displacement zones 44 in an effective fluid communication such that by turning the crankshaft of one of devices 100, a plurality of separate, simultaneous, phased, reciprocating flow cycles are established between devices 100. Thus, for the relay system 110 shown in FIG. 9, a first reciprocating flow cycle is established between displacement zones 44*a* of devices 100, a second simultaneous reciprocating flow cycle is established between displacement zones 44*b*, and a third simultaneous reciprocating flow cycle is established between displacement zones 44*c*.

In relay system 110, conduits 116, 118 and 120 place devices 100 in effective fluid communication by directly linking the respective displacement zones 44*a*, 44*b*, and 44*c* of the two devices. However, in addition to direct linkages, other types of effective fluid communication linkages (e.g., piston assemblies, etc.) could also be used, so long as fluid displacement in a displacement zone 44 of one of devices 100 produces a corresponding displacement in a corresponding displacement zone 44 of the other device 100.

In inventive relay system 110, the angular position and/or movement of one device 100 is automatically replicated in the other device 100. Additionally, inventive relay system 110 allows unlimited rotation of the devices 100. Thus, inventive relay system 110 is well suited for use as a steering relay system or other relay device particularly where there is a need to maintain phase relationship between the input and output.

Figures 10A, 10B:
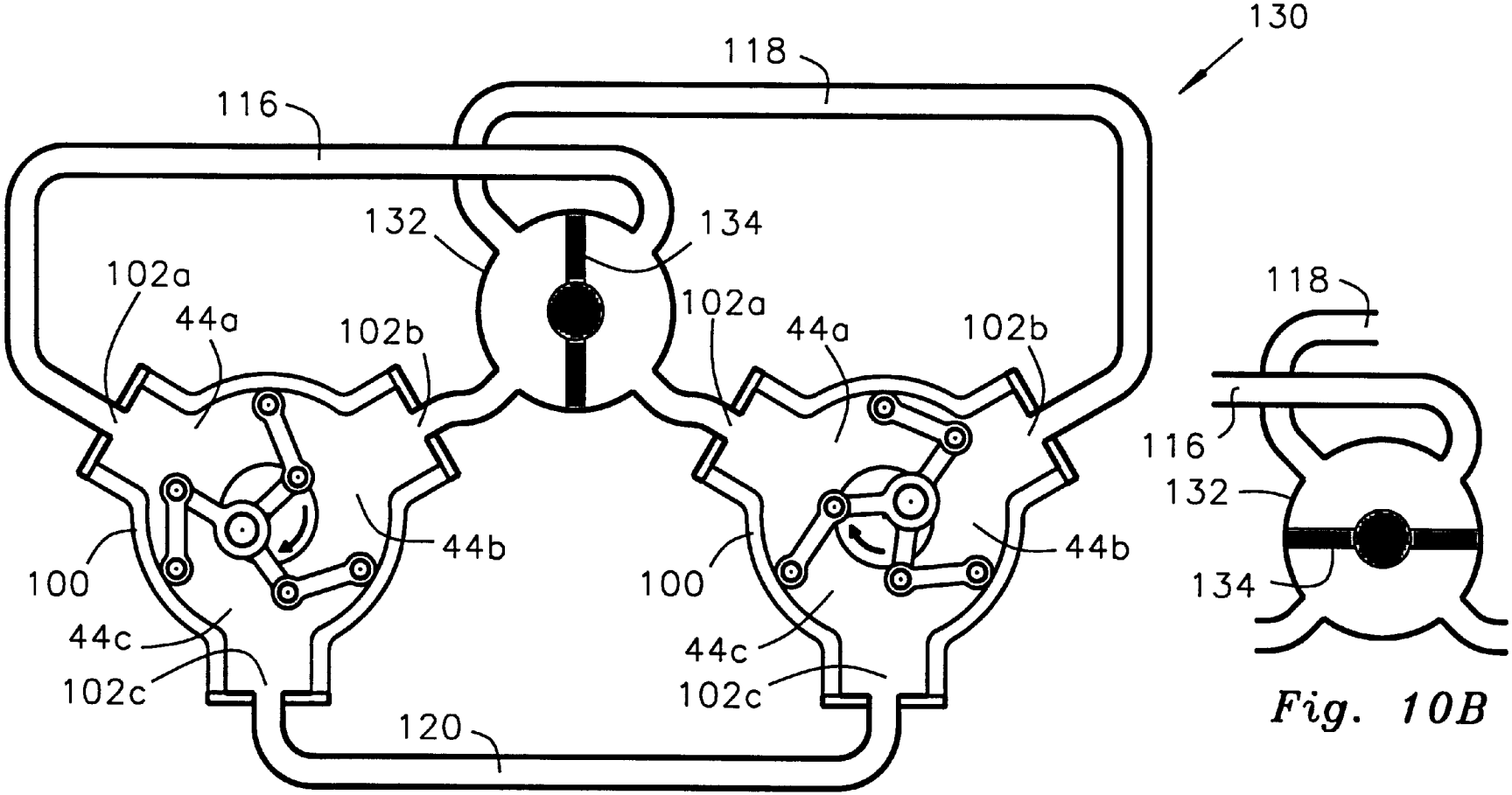
FIGS. 10A–B schematically illustrates an embodiment 130 of the inventive relay system.

An alternative embodiment 130 of the inventive relay system is depicted in FIG. 10A. Relay system 130 is substantially identical to relay system 110 except that a crossover valve 132 is disposed in conduits 116 and 118. Crossover valve 132 preferably comprises a four-port valve commonly known as a reversing valve.

Crossover valve 132 can be used to selectively reverse the responsive rotational direction produced by system 130. In FIG. 10A, valve gate 134 is positioned such that a clockwise rotation of the first device 100 causes an equivalent, clockwise rotation of the second device 100. In FIG. 10B, valve gate 134 is positioned such that a clockwise rotation of the first device 100 will produce an equivalent but counterclockwise rotation of the second device 100. Crossover valve 132 produces this result by 118 such that communication linkages of the conduits 116 and 118 such that displacement zone 44*a* of the first device 100 is placed in effective fluid communication with displacement zone 44*b* of the second device 100 and displacement zone 44*b* of the first device 100 is placed in effective fluid communication with displacement zone 44*a* of the second device 100.

Figure 11:
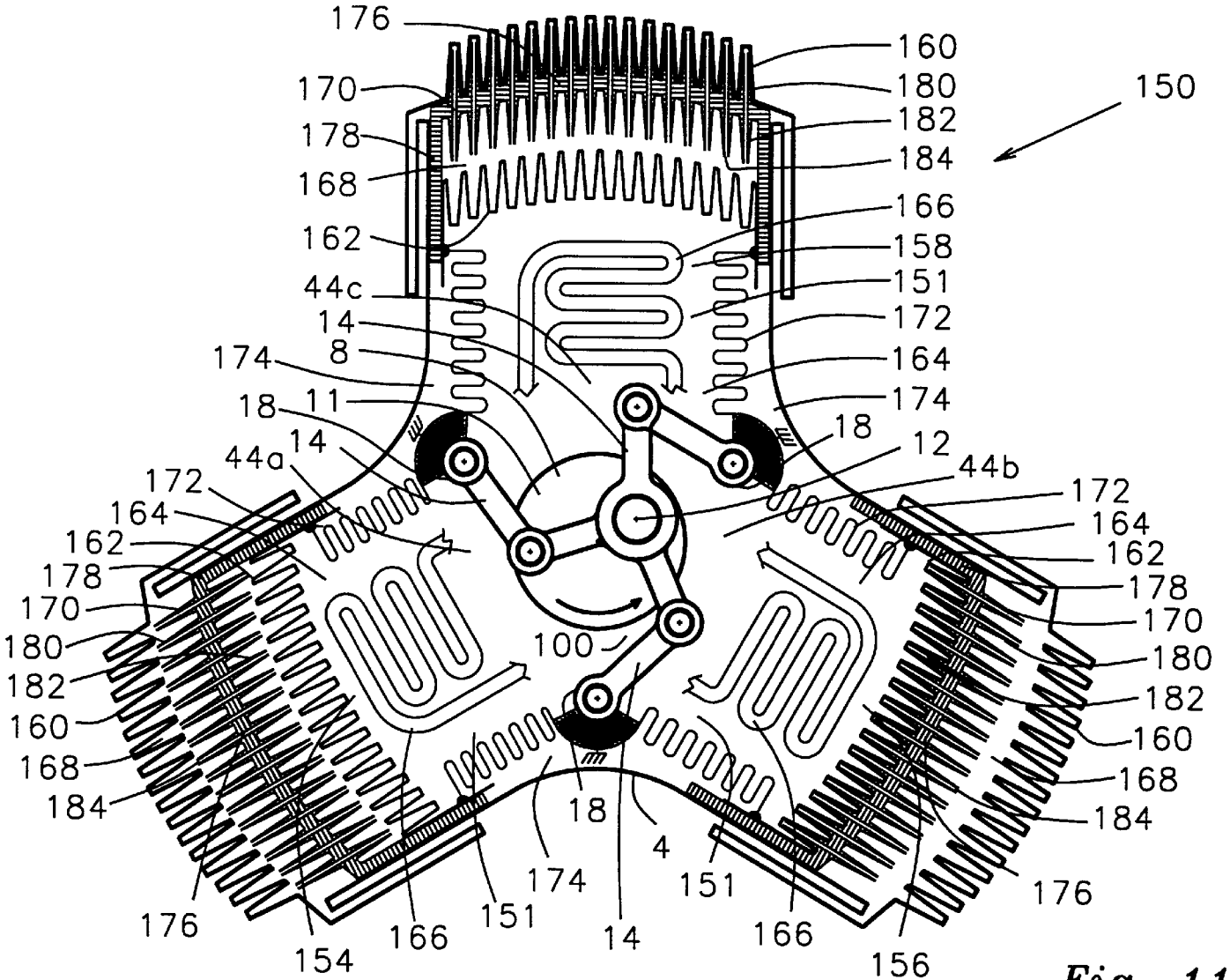
FIG. 11 provides a cutaway end view of an embodiment 150 of a stirling-type engine provided by the present invention.
Figure 12:
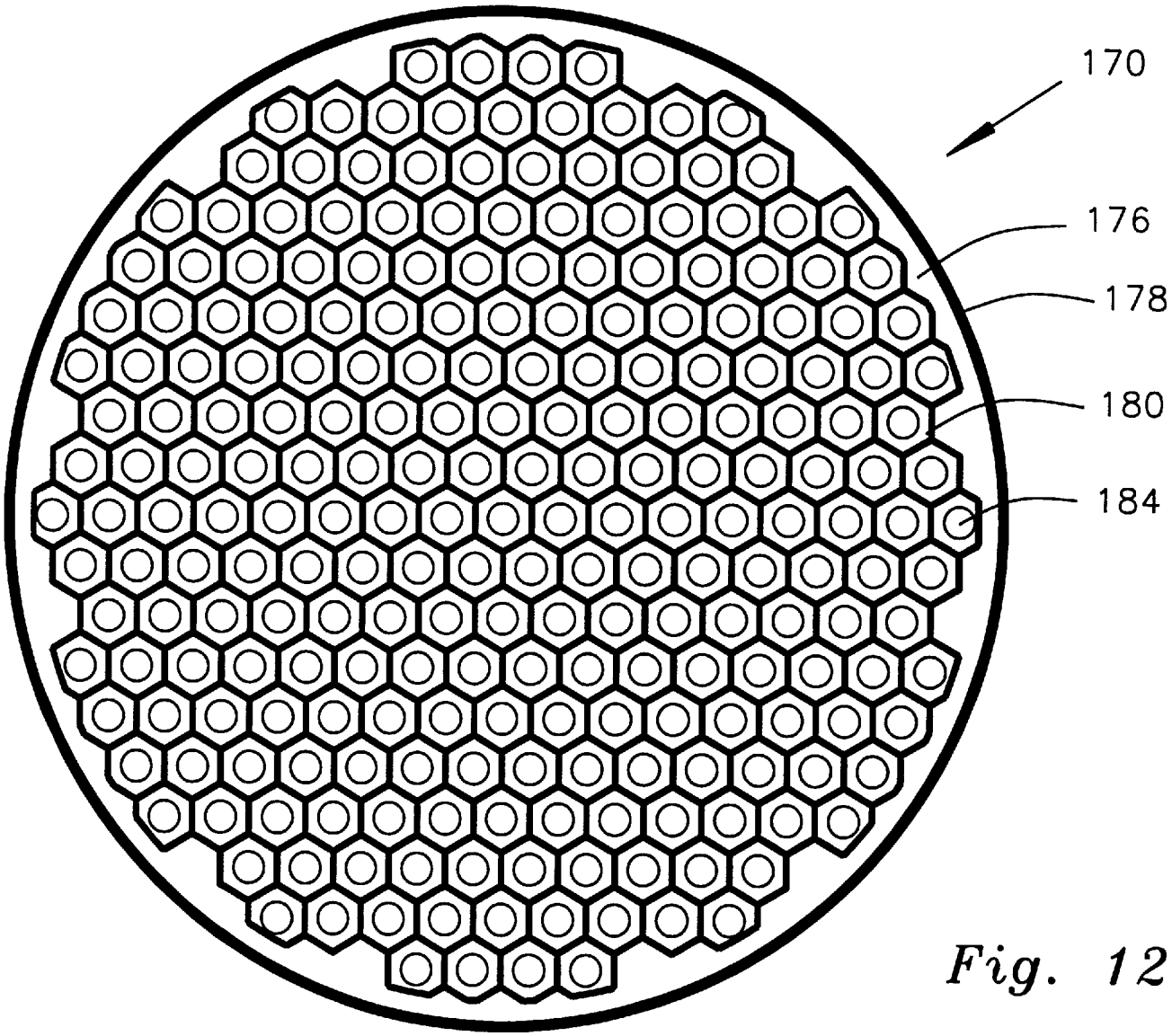
FIG. 12 provides an end view of a Ringbom displacer 170 employed in inventive engine 150.
Figure 14:
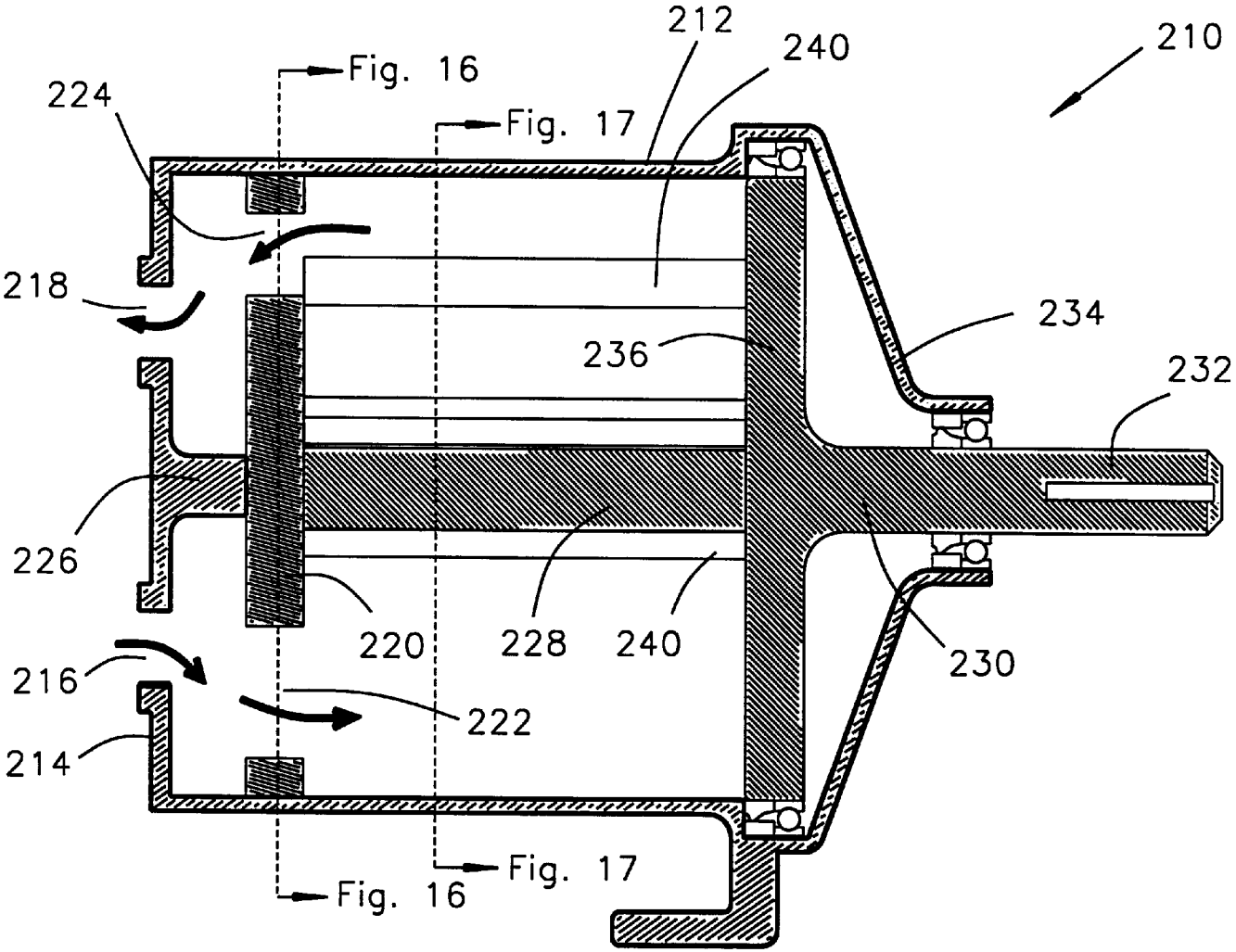
FIG. 14 provides a cutaway elevational side view of an embodiment 210 of the inventive Type B apparatus.
Figure 17:
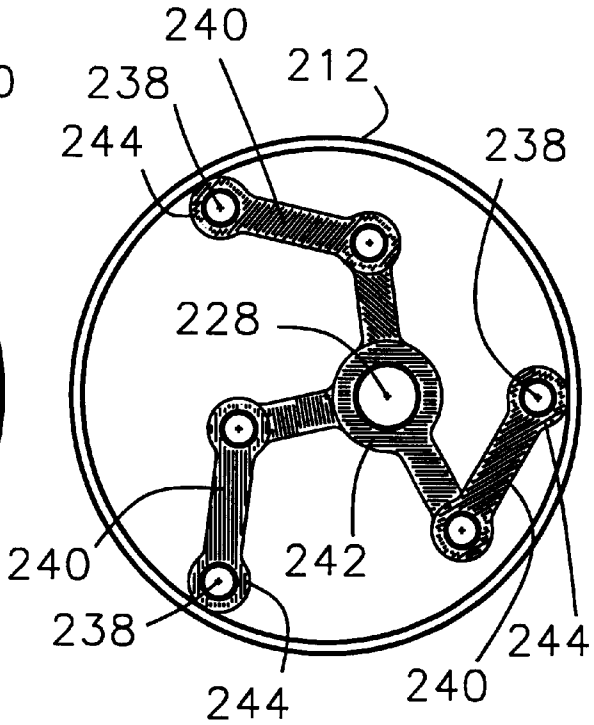
FIG. 17 provides a second cutaway elevational end view of inventive apparatus 210.
Figure 16:
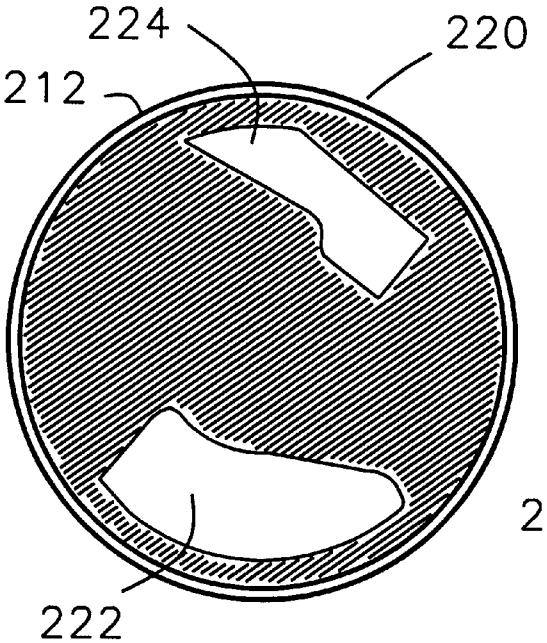
FIG. 16 provides a first cutaway elevational end view of inventive apparatus 210.
Figure 15:
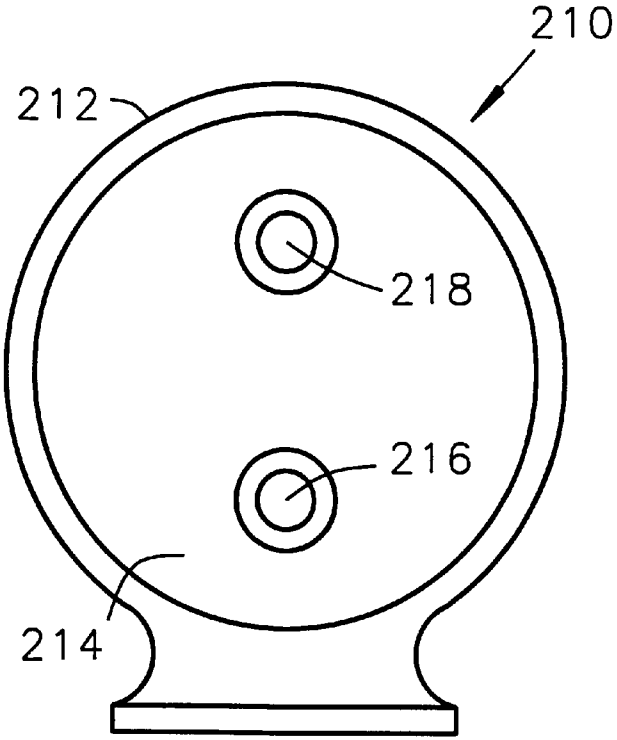
FIG. 15 provides an elevational end view of apparatus 210.

An embodiment 150 of a stirling-type engine provided by the present invention is depicted in FIGS. 11 and 12. Although engine 150 is depicted as having three power chambers 151, it will be understood by those skilled in the art that the inventive engine could alternatively have two, four, or more power chambers. Inventive engine 150 preferably comprises: a Type A displacement system 100 wherein the distal ends 18 of articulated displacement members 14 are pivotably secured in fixed position in housing 4; a first cylinder 154 positioned in fluid communication with the displacement zone 44*a*; a second cylinder 156 positioned in fluid communication with displacement zone 44*b*; and a third cylinder 158 positioned in fluid communication with displacement zone 44*c*.

Each of cylinders 154, 156, and 158 preferably includes: an outer interdigitated heating head 160; an interdigitated, power piston 162 reciprocatably positioned in the cylinder; an hydraulic fluid chamber 164 defined between the displacement zone 44 and the piston 162, a cooling loop or other cooling system 166 provided in chamber 164 for removing thermal energy from the hydraulic fluid; a working gas chamber 168 defined between reciprocating drive piston 162 and heating head 160; a Ringbom-type regenerative displacer 170 reciprocatably positioned in the working gas chamber 168 between power piston 162 and head 160; and an extensible wall 172 which surrounds the hydraulic fluid chamber 164 and defines within engine 150 around hydraulic fluid chamber 164 a gas buffer space 174 having a substantially constant pressure.

Displacer 170 is preferably made of material which has low thermal conductivity such as ceramic. Extensible wall 172 is preferably bellows, but may also be formed by concentric cylinders slidably positioned and sealed by rolling sock devices, or sealed by sliding seals or other sealing devices well known in the art. A cutaway side view of regenerative displacer 170 is provided in FIG. 11. An end view of displacer 170 is provided in FIG. 12. Displacer 170 preferably comprises: a rounded, substantially circular plate 176 which extends across the interior of the working gas chamber 168; an annular Ringbom piston element 178 extending rearwardly from the outer edge of plate 176; a plurality of forward frusto-conical structures 180 covering the forward side of plate 176; a plurality of rearwardly extending frusto-conical structures 182 aligned with forward structures 180 and covering the rearward side of circular plate 176; and a plurality of bores 184 formed through displacer 170. Each bore 184 extends through plate 176 and through an aligned pair of forward and rearward frusto-conical structures 180 and 182.

Various types of stirling engines are well known in the art. In general, a stirling engine is an external combustion engine which can be powered by substantially any available fuel. In each working gas chamber 168 of the engine, a trapped working gas is alternately heated and cooled. Heating the gas raises its pressure such that the pressurized gas pushes against a piston 162. When the gas is cooled, it contracts and allows the piston to return to its original position. The working gas is preferably a low molecular weight gas such as helium or hydrogen, etc. (most preferably helium). Compared to a higher molecular weight gas such as air, a low molecular weight gas will have a lower relative specific heat such that less energy is needed to obtain a given temperature increase.

As is typical in stirling-type engines, the displacers 170 used in inventive engine 150 operate to alternately move the working gas between the hot and cold ends of chamber 168. In each power chamber, the motion of displacer 170 typically leads the motion of piston 162 by about 90°. First, the displacer moves to the cold end of the chamber (i.e., toward piston 162), thereby displacing the working gas toward the hot end of the chamber (i.e., toward heating head 160). The gas is thus heated and its pressure increases. As the pressure increases, that increase is transmitted through piston 162, into hydraulic fluid chamber 164, and thence brought to bear on articulated displacement members 14, causing crank assembly 8 to rotate. The working gas pushes piston 162 toward displacement zone 44.

As crank assembly 8 rotates and the volume of working gas chamber 168 increases, the gas pressure therein decreases, eventually reaching a pressure lower than the relatively constant pressure found in gas buffer space 174. At this time, the pressure difference between the bottom and top surfaces of annular Ringbom piston element 178 then causes the displacer to move toward the hot end of the piston chamber. The working gas is thus displaced toward the cold end of the chamber so that the gas is cooled and the pressure of the gas drops even further. The pressure within hydraulic fluid chamber 164 is always essentially equal to said gas pressure, therefore the force exerted on articulated displacement members 14 is likewise reduced, which provides the force to continue to rotate crank assembly 8 back toward the position first mentioned above. As crank assembly 8 nears the position where displacement zone 44 is at minimum volume, the gas pressure rises to a value higher than the relatively constant pressure found in gas buffer space 174, at which time displacer 170 is again forced to the cold end toward piston 162 and the cycle is completed.

Due to its structure, displacer 170 also acts as a regenerator which facilitates the heat transfer process and greatly increases the fuel efficiency of inventive engine 150. The bores 184 and frusto-conical structures 180 and 182 of displacer 170 form a regenerative matrix. As hot gas passes through bores 184, it heats the regenerative matrix. More specifically, as the hot gas travels toward the cold end of the chamber, the regenerative matrix is heated by absorbing a substantial portion of the thermal energy contained in the gas. Removing this energy from the gas cools it substantially, thereby reducing the cooling demand on cooling loop 160 and/or allowing the attainment of a much lower cold gas temperature. Later in the cycle, as the cold gas passes back through the regenerative matrix, it recovers the thermal energy left behind in the previous cycle. Thus, when the gas reaches the hot end of the chamber, less fuel is required to heat the gas and/or a much higher hot gas temperature can be obtained. As is the case in substantially all stirling-type engines, the greater the difference between the cold end and hot end temperatures of the working gas, the greater the power output of the engine.

As seen in FIG. 11, heads 160 and pistons 162 are configured to correspond to the structure of displacers 170 so that forward frusto-conical structures 180 of displacer 170 can be closely received in head 160 and the rearward frusto-conical structures 182 of displacers 170 can be closely received in pistons 162. Thus, as displacer 170 moves to the cold end of the chamber, the displacer 170 nests in power piston 162 such that the volume of the cold space approaches zero. Likewise, when displacer 170 moves to the hot end of the chamber, the displacer nests into heating head 160. The close nesting of displacer 170 in heating head 160 and in piston 162 provides two major advantages. First, dead volume within the working-gas chamber 168 is minimized such that, during the appropriate phases of the heat transfer cycle, substantially all of the working gas is swept from the cold and hot regions of the chamber. Second, the nesting of displacer 170 provides a close, high surface area contact with heating head 160 and with piston 162 such that, one surface of displacer 170 is directly heated by head 160 to a temperature approaching that of the head, and the opposite surface is directly cooled by piston 162 to a temperature approaching that of the piston. In addition to these benefits, the displacer 170, because of its Ringbom configuration, tends to "overstroke" in a manner such that displacer 170 stops momentarily in its nested positions. This discontinuous motion enhances heat transfer and also moves the engine closer to the Schmidt cycle so that even higher efficiencies are obtained.

As with most other stirling-type engines, engine 150 is preferably a sealed, pressurized system. Increasing the pressure of the working gas increases the power output of the engine.

In contrast to the stirling-type engines heretofore known in the art, the crank assembly 8 of engine 150 is not driven by mechanical linkages tying crankshaft assembly 8 to pistons 162. Rather, driving force is transferred from pistons 162 to displacement system 110 by means of the hydraulic fluid contained in hydraulic fluid chambers 164. Thus, pistons 162 can be designed with a large bore and short stroke to optimize the thermodynamic and aerodynamic considerations of the stirling cycle, while crankshaft assembly 8 can be sized to accommodate known materials technology. In addition to acting as a force multiplier, the hydraulic fluid acts as a primary coolant and a lubricant. Because (a) displacers 170 and pistons 162 do not utilize typical mechanical linkages, and (b) there is no substantial pressure differential between the working gas and the hydraulic fluid, pistons 162 can be relatively thin and lightweight. The ability to employ thin, lightweight pistons 162 desirably decreases the overall weight of engine 150 and greatly enhances the heat transfer characteristics of the inventive engine. Further, since the present invention eliminates the need to extend any type of mechanical displacer linkage through the piston, the present invention eliminates sealing and leakage problems commonly encountered in other stirling-type engines.

Extensible wall 172 separates the buffer gas contained in space 174 from the hydraulic fluid while accommodating the reciprocating movement of pistons 162. Each extensible wall 172 is subjected to gas pressure variations and must be robust enough to withstand both positive and negative excursions from constant pressure occurring in buffer space 174. Extensible wall 172 may be formed of bellows made of, for example, electroformed nickel alloy or formed and welded rings of steel alloy. Alternatively, extensible wall 172 may be constructed of coaxial non-contacting metallic cylinders, sealed by a rolling sock mechanism known in the art, such as taught by Fluhr in U.S. Pat. No. 3,673,927.

Buffer spaces 174 should be sufficiently large to accommodate the reciprocating movement of pistons 162 and Ringbom pistons 178, such that buffer spaces 174 are maintained at near constant pressure. However, because the strokes of pistons 162 and 178 are quite small relative to the diameters of cylinders 154, 156, and 158 the necessary size of buffer spaces 174 and the required expandability of extensible wall 172 are greatly reduced.

Inventive engine 150 is ideally suited for use as an aircraft power plant and for use in numerous other applications. With an appropriate arrangement and number of power chambers 151, it is possible to produce an engine with almost 100% static and dynamic balancing. Further, engine 150 can utilize a steady, highly efficient external combustion process. Thus, engine 150 is silent, produces substantially no vibration, and can be powered by substantially any available fuel. Further, engine 150 will not lose power at altitude. Rather, because ambient temperature decreases with altitude such that even greater operating temperature differentials are obtainable, the power provided by inventive engine 150 will actually increase at altitude.

As with other stirling-type engines, inventive apparatus 150 can also be used as a heating and/or cooling system rather than as a power plant. When heat energy is applied to and removed from inventive apparatus 150, in the manner described previously, the apparatus produces shaft horsepower. However, if the system is reversed such that shaft horsepower is delivered to inventive apparatus 150, a large temperature differential can be created between the hot and cold ends of the system. When operated in this manner, inventive apparatus 150 could—at least theoretically—provide a cold end temperature sufficiently low for producing liquid nitrogen, and liquid oxygen, and for other such cold and/or cryogenic processes.

An alternative displacement system 200 provided by the present invention (referred to hereinafter as a Type B System) is illustrated in FIGS. 13A–L. Type B System 200 is preferably identical to Type A System 2 except that crankpin 202 remains in a fixed, eccentric position in housing 4 while the distal ends 18 of articulated displacement members 14 rotate in a circular path. Although other means could also be used, rotational movement will typically be imparted to distal ends 18 either by pivotably securing distal ends 18 to a revolving casing or by pivotably securing distal ends 18 to a plurality of revolving mounting posts. Such posts are typically secured to, and extend from a disc or other rotating structure positioned at one end of housing 4.

FIGS. 13A–L depict 30° increments of a complete 360° revolution of Type B System 200. The embodiment shown in FIGS. 13A–L includes a fluid inlet port 204 and a fluid outlet port 206 formed in a stationary end plate 208. Inlet port 204 is positioned such that each displacement zone 44 moves into fluid communication with port 204, as the displacement zone 44 progresses toward its maximum volume configuration. Fluid outlet port 206 is positioned such that each displacement zone 44 moves into fluid communication with port 206 as the displacement zone 44 progresses toward its minimum volume configuration. As will be understood by those skilled in the art, fluid ports 204 and 206 could alternatively be placed through opposing end plates. However, the location of both the ports 204 and 206 through a single end plate greatly simplifies the construction, assembly, and maintenance of the Type B System.

An additional embodiment 210 of the Type B System 200 is depicted in FIGS. 14–17. Inventive apparatus 210 includes a housing 212 having a rearward end plate 214; an inlet connection 216 and an outlet connection 218 provided through plate 214; a rearward interior end plate 220 secured in fixed position in the housing 212 and having an inlet port 222 and an outlet port 224 formed therethrough; a fixed interior dividing wall 226 which isolates inlet port 222 from outlet port 224 such that fluid flow from inlet connection 216 is directed through inlet port 222 and fluid flow from outlet port 224 is directed through outlet connection 218; a crankpin 228 extending forwardly from fixed, rearward interior plate 220 such that crankpin 228 remains in a fixed, eccentric position within housing 212; and a rotating crank assembly 230. The rotating crank assembly 230 comprises: a crankshaft 232 which extends through the forward wall 234 of housing 212; a rotating plate 236 provided on the interior end of crankshaft 232 and extending across the interior of housing 212; and a plurality of mounting posts 238 which extend rearwardly from the perimeter of—and rotate with—plate 236. Apparatus 210 further comprises a plurality of articulate displacement members 240 having proximal ends 242, rotatably mounted on crankpin 228, and distal ends 244 pivotably mounted on mounting posts 238.

As will be apparent to those skilled in the art, inventive apparatus 210 can be employed as a pump, a compressor, or other similar device by using a motor or other drive system to rotate crankshaft 232. Alternatively, inventive apparatus 210 can be used as a fluid powered motor, a flow meter, or other such device by powering, directing, or otherwise conducting a fluid through apparatus 210.

The present invention provides numerous advantages over the prior art. In addition to the advantages and benefits already discussed, embodiments such as Type A apparatus 70, engine 150, and Type B apparatus 210 allow ready access to substantially all internal components by simply removing the forward end cover of the housing. Thus, the inventive devices are simpler to manufacture and are relatively easy to assemble, disassemble, and maintain. Additionally, the provision, as in inventive devices 70 and 210 of both an outlet port and an inlet port in a single end plate further simplifies the manufacture, assembly, disassembly, and maintenance of the inventive system. Further, the inclusion of friction reducing elements in the displacement member assemblies greatly enhances, and improves, the performance and efficiency of the inventive systems. Unlike many prior art devices, the ability to completely install the vane assemblies through one end of the inventive apparatus desirably allows the use of rolling element bearings. Because of their configurations and assembly requirements, many prior art devices cannot inherently accommodate such friction reducing elements.

The multiple closed hinge configuration of the articulate displacement members used in the inventive devices also eliminates bending moment and slippage problems encountered in prior art devices.

It is well known in the art that the force applied to a crankshaft by a connecting rod exerts a bending moment on the crankshaft. To resist this bending moment, most crankshafts require a bearing on each side of the crank throw (or crankpin). In such an arrangement, any friction reducing bearing used on the crank throw must be split to permit installation and removal. Conventional ball or needle bearings cannot be employed on such a crankshaft.

The present inventive device solves this problem by substantially eliminating the bending moment exerted on the crankshaft, thus permitting the use of a single-ended crank assembly 8 which readily accepts a wide variety of bearing types. The bending moment is substantially eliminated by the plurality of articulated displacement members 14. Consider a single member 14. The outer vane element 28 is free to move in an arcuate manner around pivot 42, but is otherwise constrained. Inner vane element 26 is free to move about hinge pin 34, but any potential bending moment is resisted by the hinge elements. Further, any bending moment potentially applied to the crankpin 12 is resisted by the triangulation provided by the remaining members 14.

Leakage between the displacement zones of the inventive devices can generally be prevented through the use of close tolerances in component manufacture. Alternatively, or in addition, the inventive devices can include: spring loaded seals provided in the tops and bottoms of vane elements 26 and 28, which seal against the interior end walls of the housing; spring loaded seals or lip seals can be employed to prevent leakage through the hinge elements of the vanes; and wiping or rubbing seals can be used to prevent leakage between the distal ends of the displacement members and the interior sidewall of the device housing or casing.

Figure 18:
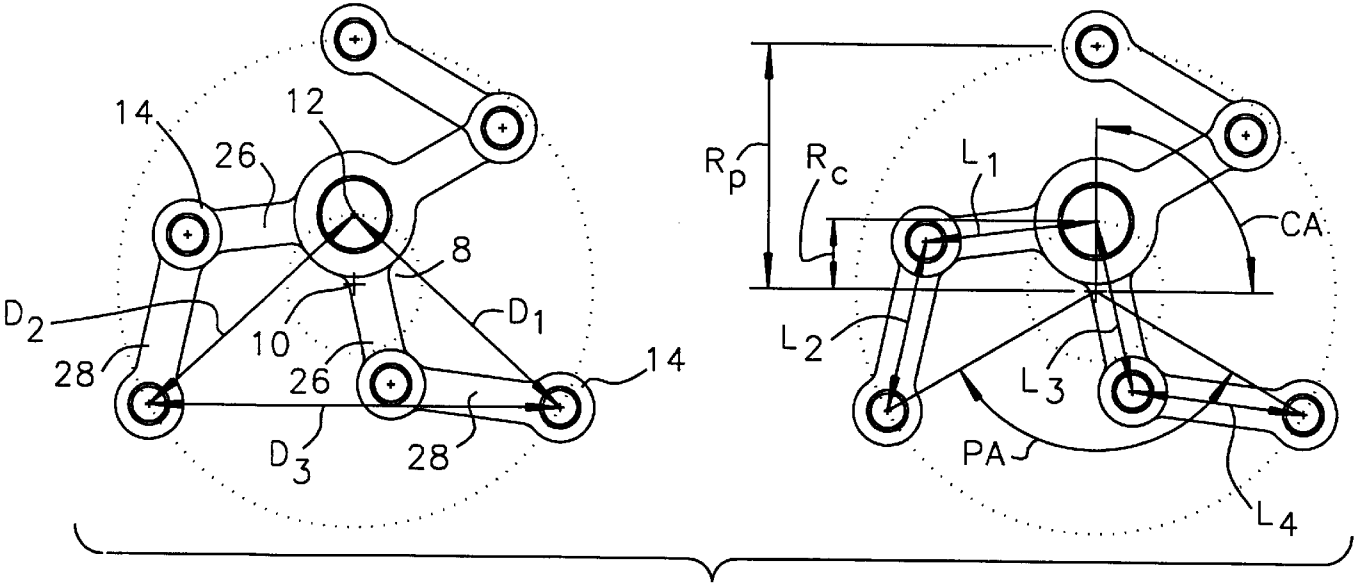
FIG. 18 defines variables that are useful for predicting the amount of fluid moved during each cycle.

In another aspect, the present invention allows the dimensions and configuration of the inventive apparatus to be selectively varied in order to obtain a specific desired flow pattern from each displacement zone 44. FIG. 18 depicts the most significant dimensional features of the inventive apparatus and FIGS. 19–27 explain in a general way how these values can be adjusted so as to vary the volume and timing of the duty cycle It should be noted at the outset that the instant invention is pictured as consisting of three vanes that are spaced at equal intervals (i.e., 120°) about the interior of the chamber in which they have been installed. Further, the vane assemblies are all illustrated as being the same dimensions: all of the inner vane elements 26 are the same length, as are the lengths of the outer vane elements 28. That being said, those skilled in the art will recognize that more—or fewer—than three vane assemblies could be placed within the chamber; that the dimensions of each vane need not be identical in each case (i.e., the inner 26 and outer 28 vane elements might be different lengths in each vane assembly); that the vane pairs need not all be "bent" in the same direction; and, that the arcuate size of the various chambers need not be equal. The equations and discussion that follow are general enough to accommodate these alternative designs and, indeed, the instant inventor specifically contemplates that these sorts of arrangements are possible and potentially useful.

By way of general introduction, the various dimensional variables that will be used in equations hereinafter are graphically defined in FIG. 18. As is shown in that figure, $L_1$=the length of a first inner vane element 26, from pivot point to pivot point.

$L_2$=the length of a first outer vane element 28, from pivot point to pivot point.

$L_3$=the length of a second inner vane element 26, from pivot point to pivot point.

$L_4$=the length of a second outer vane element 28, from pivot point to pivot point.

$R_p$=the pivot radius of the articulated displacement members 14, measured as the distance from the rotational axis 10 of crank assembly 8 to the distal pivot point of the displacement member.

$R_c$=the crank radius measured as the distance from crankshaft rotational axis 10 to the proximal pivot point of inner vane elements 26, (i.e., the longitudinal axis of crankpin 12).

$D_1$=the distance from the proximal pivot point of an articulate displacement member 14 to the distal pivot point of the displacement member.

$D_2$=the distance from the proximal pivot point of an adjacent displacement member 14 to the distal point of said adjacent displacement member.

$D_3$=the distance between the distal pivot points of the adjacent displacement members 14.

PA=Pivot Angle, the subtended angle in degrees of the distal pivot points of adjacent displacement members 14 as measured from the crank shaft center of rotation 10.

Additionally, coordinate axes have been imposed on the apparatus in FIG. 18, with the origin of the "X" and "Y" axes meeting at the crankshaft center 10. For purposes of simplicity, assume that the mechanism is arranged such that two of the pivots 42 are symmetrically placed about the "Y" axis. Finally, let CA=crank angle measured in degrees.

Note that by varying this quantity from 0° to 360° it is possible to cause the mathematical representation of this machine to "rotate," thereby yielding a picture of how the various chamber volumes vary with angle and, thus, also with time.

The volume that is displaced each time a vane assembly goes through its complete cycle is proportional to the maximum volume of a displacement zone 44 minus the minimum volume of that zone 44. Note that the displacement is actually the volume of fluid moved, whereas the instant diagram (and the equations that follow) are all concerned with the measurement and calculation of the various areas in FIG. 18. Needless to say, those skilled in the art will recognize that these areas may be easily converted to volumes by multiplying the calculated cross-sectional area by the length of the chamber. If more complicated chamber shapes than cylindrical are used, the methods discussed hereinafter can be extended to accommodate those different shapes.

Define $COS_{PA}$ and $SIN_{PA}$, the cosine and sine of the Pivot Angle respectively, as follows:

$$COS_{PA}=COS\ ((180-PA)/2),$$

and $$SIN_{PA}=SIN\ ((180-PA)/2).$$

Then, the X and Y coordinates of two adjacent pivots 42 (assuming symmetry) are:

$$X_1=-X_2=COS_{PA}\cdot R_P$$

$$Y_1=Y_2=SIN_{PA}\cdot R_P,$$

where $(X_1, Y_1)$ and $(X_2, Y_2)$ are the coordinates of the two adjacent pivots 42. Let, $COS_{CA}$ be the cosine of the crank angle (CA) and $SIN_{CA}$ be the sine of that same angle. Then, the X and Y coordinates $(X_{CA}, Y_{CA})$ of the center of hinge pin 34 are given by:

$$X_{CA}=COS_{CA}\cdot R_C$$

$$Y_{CA}=SIN_{CA}\cdot R_C$$

Given these variables, the value of $D_1$ may be determined using a standard planar distance equation:

$$D_1 = \sqrt{(X_1 - X_{CA})^2 + (Y_1 - Y_{CA})^2}$$

The value of $D_2$ may similarly be determined:

$$D_2 = \sqrt{(X_2 - X_{CA})^2 + (Y_2 - Y_{CA})^2}$$

as can the value of $D_3$, $$D_3=|X_1|+|X_2|.$$

Figure 19C:
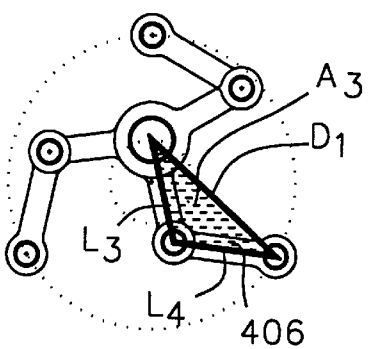
FIGS. 19A–C defines various variable quantities that are useful for predicting the amount of fluid moved during each cycle.
Figure 19B:
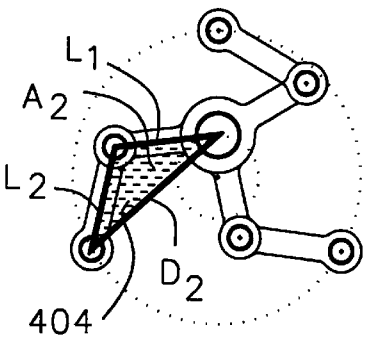
Figure 19A:
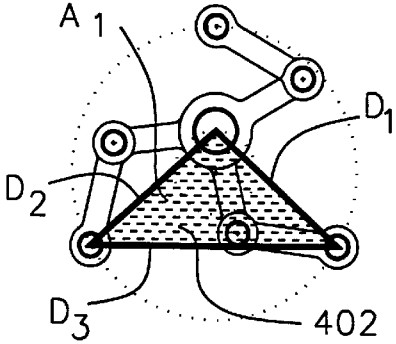

The area of each of the triangles in FIGS. 19A–C can now be determined using a standard semi-perimeter area formula. Let $S_1$ be one-half of the perimeter of the triangle in FIG. 19A, $$S_1=(D_1+D_2+D_3)/2,$$

let $S_2$ be one-half of the perimeter of the triangle in FIG. 19B, $$S_2=(L_1+L_2+D_2)/2,$$

and let $S_3$ be one-half of the perimeter of the triangle in FIG. 19C, $$S_3=(L_3+L_4+D_1)/2.$$

Given these values, it is straightforward to calculate the areas of the three triangles $A_1$ (402), $A_2$ (404), and $A_3$ (406), which triangles are illustrated in FIGS. 19A, 19B, and 19C, $$A_1 = \sqrt{S_1(S_1 - D_1)(S_1 - D_2)(S_1 - D_3)} \cdot [\mathrm{sign}(Y_{CA} - Y_1)]$$

$$A_2 = \sqrt{S_2(S_2 - L_1)(S_2 - L_2)(S_2 - D_2)}$$

and, $$A_3 = \sqrt{S_3(S_3 - L_3)(S_3 - L_4)(S_3 - D_1)}$$

Finally, the total area, A, is given by the following expression:

$$A=A_1+A_2-A_3.$$

Once again, it should be noted that the area A, which varies as the crank angle changes, is proportional to the displacement volume and can be converted into a volume by standard mathematical techniques.

Figure 20A:
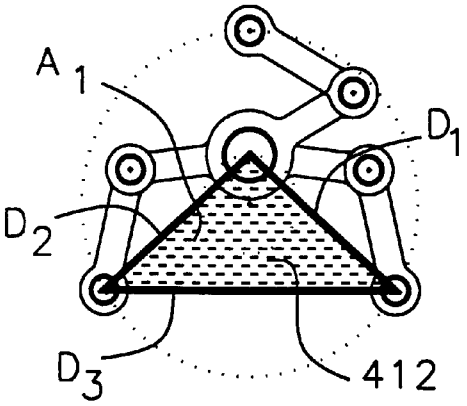
FIGS. 20A–C defines additional variable values that are useful for predicting the amount of fluid moved during each cycle.
Figure 20B:
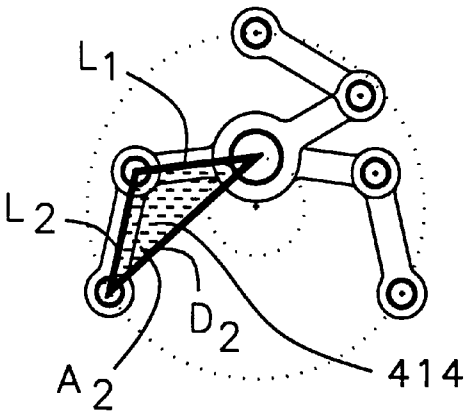
Figure 20C:
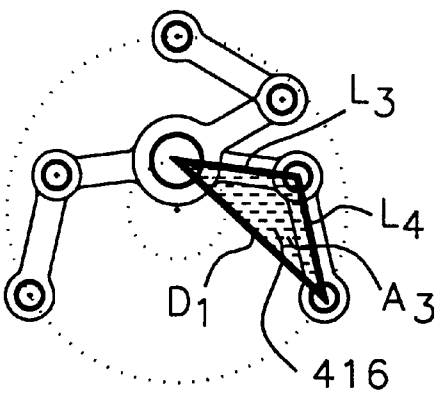

Further, displacement members 14 may be constructed with adjacent members 14 facing away from each other, for example as illustrated in FIGS. 20A, 20B, and 20C. In such case, both $A_2$ (414) and $A_3$ (416) lie outside $A_1$ (412), in which case the total area, A, is given by $$A=A_1+A_2+A_3.$$

Figure 21A:
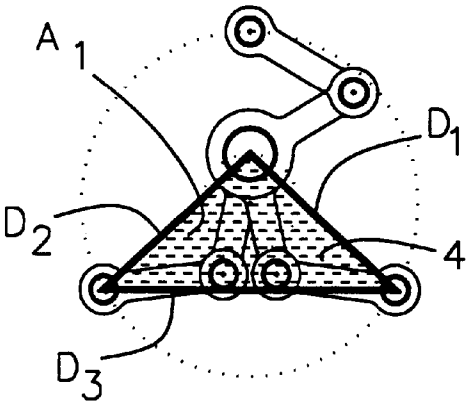
FIGS. 21A–C defines further variable quantities that are useful for predicting the amount of fluid moved during each cycle.
Figure 21B:
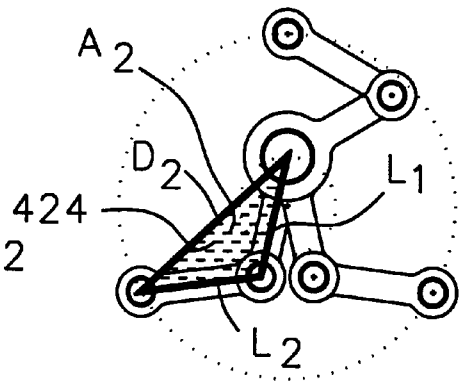
Figure 21C:
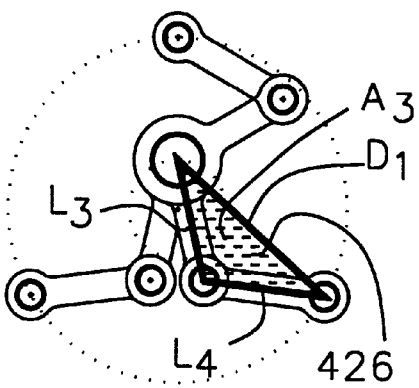

Additionally, those skilled in the art will recognize that displacement members 14 may be constructed with adjacent members 14 facing toward each other, for example as illustrated in FIGS. 21A, 21B, and 21C. In that case, both $A_2$ (424) and $A_3$ (426) lie within $A_1$ (422), and the total area, A, is given by $$A=A_1-A_2-A_3.$$

Figure 22:
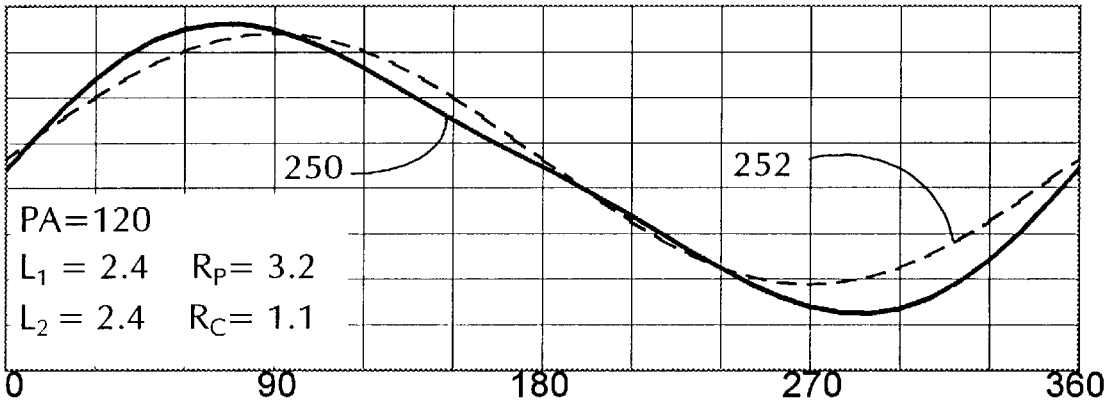
FIG. 22 is a chart that illustrates how various dimensions of the instant invention can be used to predict the volume of fluid moved during each cycle.

The equations presented previously for the area or volume of a chamber can be tracked as the crank goes through one revolution to get a picture of the compression and expansion portions of the duty cycle. Turning first to FIG. 22, the solid curve 250 in this figure displays the chamber area as a function of crank angle (0° to 360°) for the parameter values indicated on that graph: the inner vane elements 26 ($L_1$ and $L_3$) and the outer vane elements 28 ($L_2$ and $L_4$) each have relative lengths of 2.4, the pivot angle (PA) is 120 degrees, the pivot radius (RP) is 3.2, and the (relative) crank radius ($R_c$) is 1.1. With this configuration, each displacement zone 44 provides a quasi-sinusoidal flow cycle. For purposes of comparison, a fixed amplitude sine curve 252 overlays the area curve as a dashed line. Note that the compression portion of the cycle (i.e., the time during which the calculated area decreases from its maximum to its minimum, thereby expelling the contents of the chamber) extends from about 70° to about 290°. The remainder of the cycle must necessarily be the inflow phase. This means that about 220° of the cycle is devoted to compression, while 180° would normally be expected in a conventional engine or pump. Thus, a device with this configuration of elements has an asymmetric duty cycle, with the outflow cycle being longer than the inflow cycle. This particular flow characteristic is particularly desirable for stirling engine-type applications in that it effectively extends the cooling phase of the engine cycle, thereby improving engine performance.

FIGS. 23 through 27 illustrate the general character of the duty cycle for some additional combinations of parameters, compared with the same fixed amplitude sine curve 252 seen in FIG. 22. As before, these figures illustrate, in terms of crank angle, the displacement volumes (shown as the cross-sectional area of the displacement zone). Each of FIGS. 23–27 is based on the inventive apparatus having a relative pivot radius ($R_p$) of 3.2.

Figure 23:
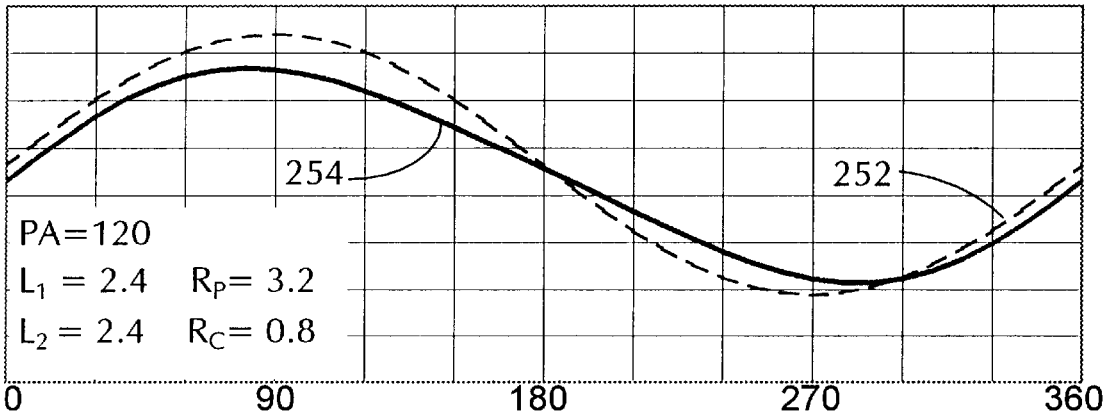
FIG. 23 is a chart that illustrates how various dimensions of the instant invention can be used to predict the volume of fluid moved during each cycle.

The configuration assumed in FIG. 23 is substantially identical to that assumed in FIG. 22 except that the crank radius ($R_c$) is shortened to 0.8, resulting in flow pattern 254.

Figure 24:
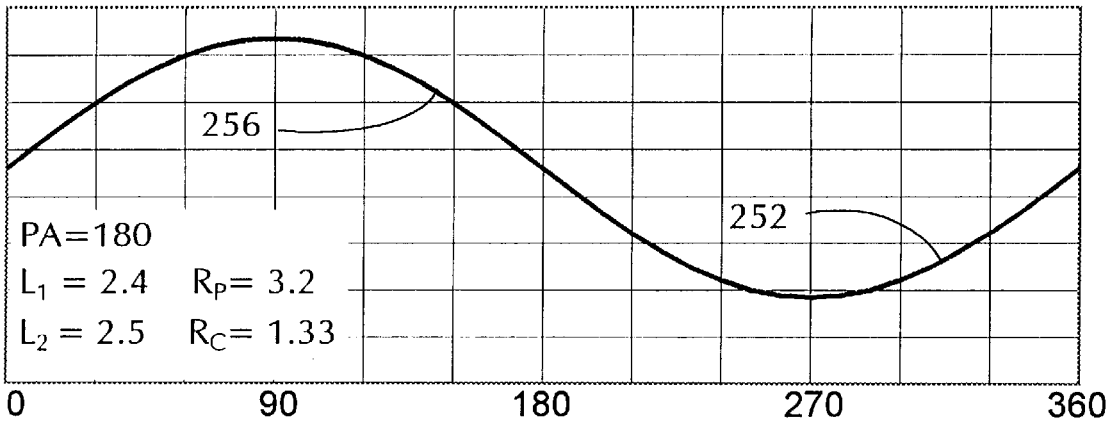
FIG. 24 is a chart that illustrates how various dimensions of the instant invention can be used to predict the displacement of fluid during each cycle.

FIG. 24 assumes a pivot angle of 180°, a crank radius ($R_c$) of 1.33, inner vane element lengths ($L_1$ and $L_3$) of 2.4 and outer vane element lengths ($L_2$ and $L_4$) of 2.5. This configuration yields a displacement 256 that is sinusoidal.

Figure 25:
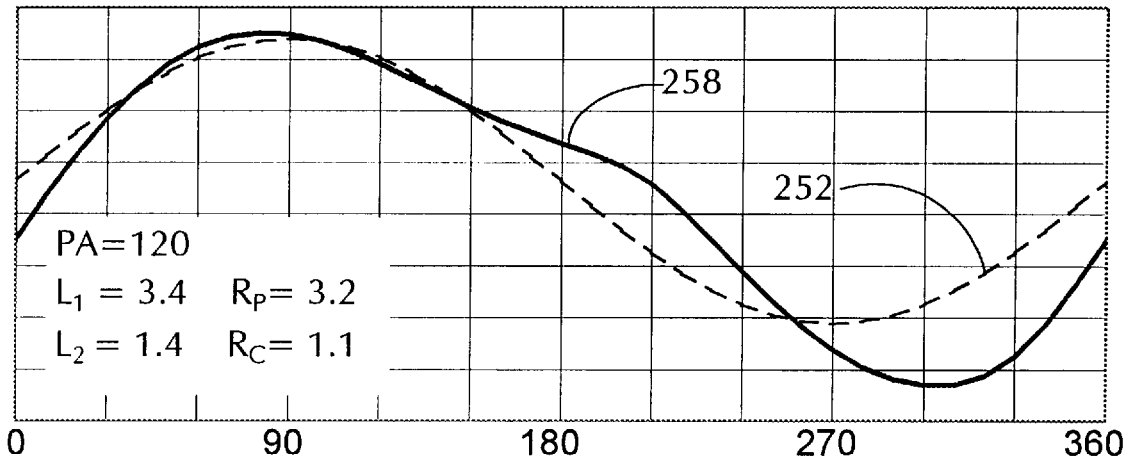
FIG. 25 is a chart that illustrates how various dimensions of the instant invention can be used to predict the displacement of fluid during each cycle.

FIG. 25 assumes a crank radius ($R_c$) of 1.1 and illustrates the effect of still another change in relative vane lengths. FIG. 25 assumes a pivot angle (PA) of 120°, inner vane element lengths ($L_1$ and $L_3$) of 3.4 and outer vane element lengths ($L_2$ and $L_4$) of 1.4. Although this configuration provides substantially the same displacement as that of FIG. 22, the outflow portion of the resulting flow cycle 258 exhibits a unique, non-uniform characteristic.

Figure 26:
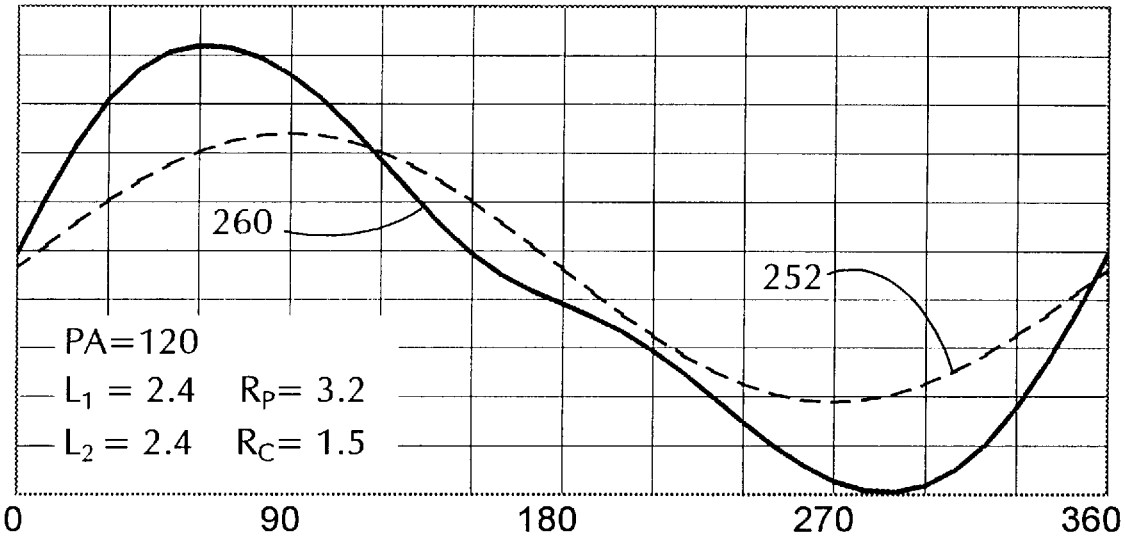
FIG. 26 is a chart that illustrates how various dimensions of the instant invention can be used to predict the displacement of fluid during each cycle.

FIG. 26 uses the values from FIG. 22, except that the crank radius ($R_c$) is set to 1.5. This yields yet another non-sinusoidal displacement 260, with the outflow shifted down from the sine curve, which is the opposite effect from the parameters used in FIG. 25.

Figure 27:
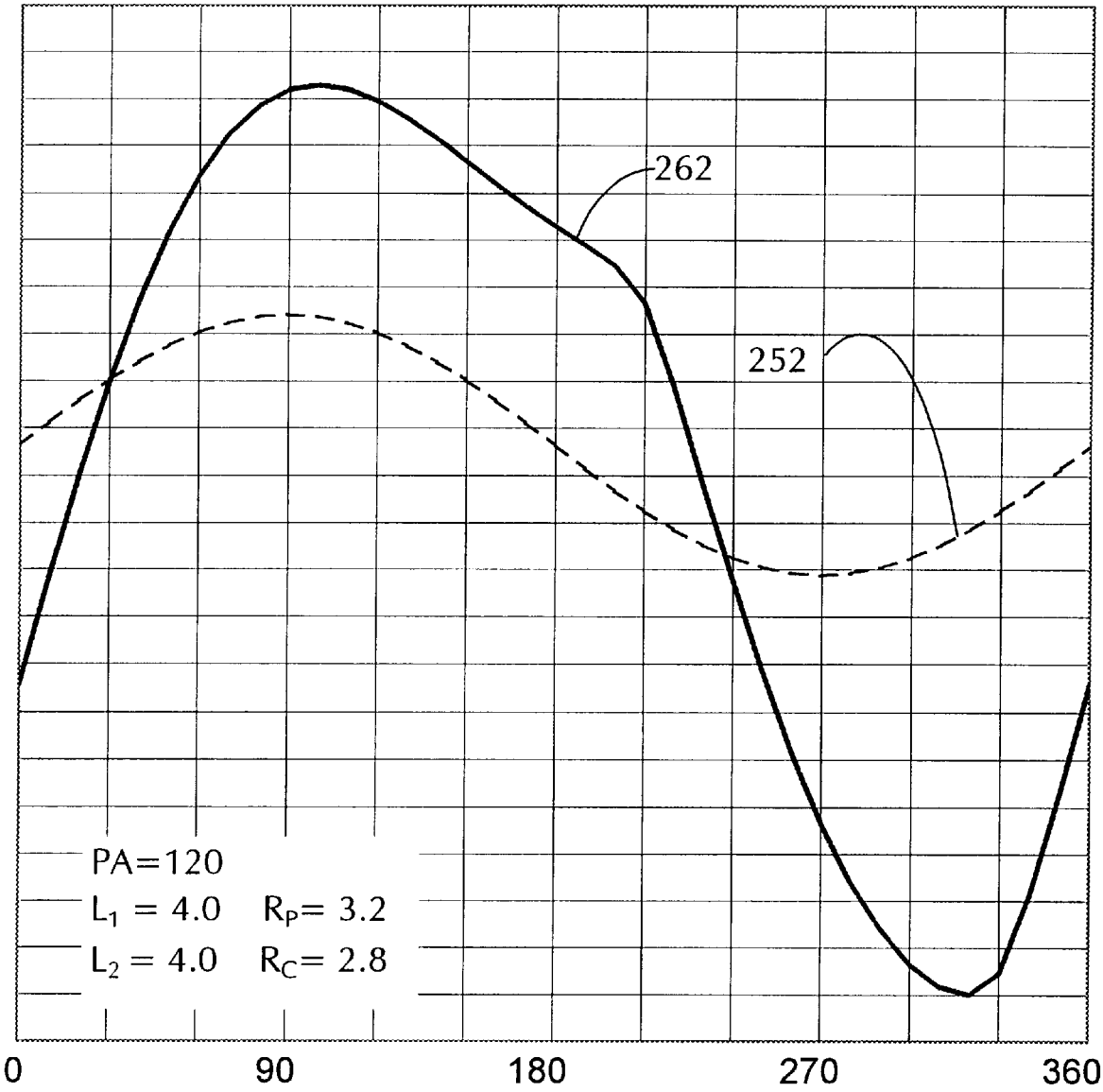
FIG. 27 is a chart that illustrates how various dimensions of the instant invention can be used to predict the displacement of fluid during each cycle.

Finally, FIG. 27 illustrates a much greater displacement 262 possible within the same pivot radius ($R_P$). In this illustration, inner vane element lengths ($L_1$ and $L_3$) and outer vane element lengths ($L_2$ and $L_4$) are set to 4.0, and crank radius ($R_C$) is 2.8.

Note that it is possible, through appropriate dimensional choices, to create highly asymmetric intake and expulsion phases—or symmetric phases if that is desired. The recognition of how the vane element lengths, the pivot radius, and the crank radius interact in their effect, and how this interaction might be manipulated to advantage, is previously unknown in the art. Although there is no single simple closed form equation that would tell one skilled in the art how to construct a device that exhibits any particular desired flow characteristic, the instant inventor has some general guidelines and approaches that can be used in combination with trial and error to reach the desired configuration. First, because of various physical constraints of the system the following size-related inequalities must be true at all times:

$$L_1+L_2>R_C+R_P$$

$$L_3+L_4>R_C+R_P$$

$$R_C<R_p$$

$$L_1\geqq R_C,$$

$$L_3\geqq R_C,$$

$$R_P-R_C>|L_2-L_1|$$

and, $$R_P-R_C>|L_4-L_3|$$

These inequalities limit the number of size combinations that need to be examined. Beyond that, it should be noted that one of the six variables, $L_1$, $L_2$, $L_3$, $L_4$, $R_P$, and $R_C$ may arbitrarily be set to some fixed quantity, say, unity, without affecting the length of the intake/expulsion cycle. The sizes of the remaining variables would then be expressed as multiples of the chosen fixed length. Additionally, the external/internal size constraints of the system into which the instant invention is installed may eliminate some choices of $R_P$ and $R_C$. Finally, charts of the sort found in FIGS. 18–27 may be generated using the formulas presented previously. These charts can be used to predict the flow performance of any given combination of the six variables that characterize the system.

According to still another aspect of the instant invention, there is provided an inventive apparatus which is used to actuate a linear hydraulic cylinder, or rotary hydraulic actuator, or other device. As will be apparent, the configuration of the inventive apparatus used can be selected, in accordance with the parameters set forth above, to provide a specific quasi-sinusoidal or other flow pattern which will impart to the device a particularly preferred actuation cycle. For example, by placing one or more independent displacement zones 44 of Type A apparatus 100 in fluid communication with a hydraulic mechanism or other device, apparatus 100 can be used to impart a continuous, quasi-sinusoidal and/or non-uniform actuation cycle to the device. Moreover, the quasi sinusoidal and/or non-uniform actuation cycle can be imparted by simply rotating the crankshaft assembly 8 of inventive apparatus 100 at constant speed. As will also be apparent, the displacement zones 44 of inventive apparatus 100 can be simultaneously employed to individually actuate a plurality of devices.

Figure 28:
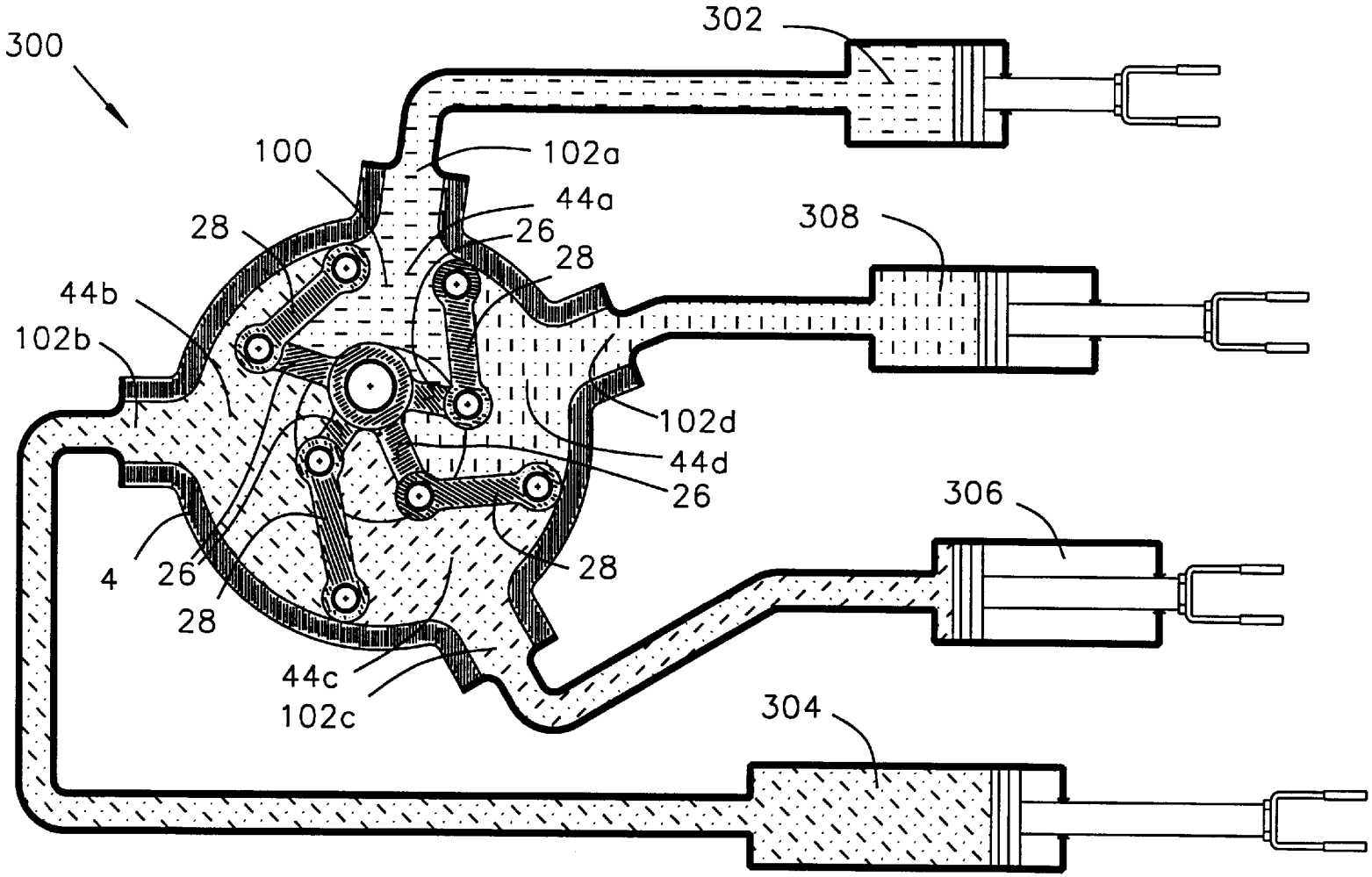
FIG. 28 illustrates an application 300 of embodiment 100 of the inventive apparatus.

FIG. 28 illustrates an application 300 for apparatus 100, in which hydraulic cylinders 302, 304, 306, and 308 are in fluid communication with ports 102*a*, 102*b*, 102*c*, and 102*d*, respectively. The hydraulic cylinders might be used, for example within a materials-handling machine, where there is a requirement to provide repetitive, synchronized, non-sinusoidal movement of the individual cylinders, powered by steady rotation of apparatus 100. In FIG. 28, apparatus 100 has been tailored to provide stroke profiles required by the specific application. This is accomplished by selecting specific lengths of inner links 26, outer links 28, and the subtended angles of chambers 44*a*, 44*b*, 44*c*, and 44*d*.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An engine comprising:

a housing having an interior space;

a revolving structure positionable in said interior space for a circuitous, revolving movement; and a plurality of articulated displacement members positionable in said interior space and defining in said interior space a plurality of displacement zones, each said displacement zone having a flow opening through which said fluid alternately both enters and exits said displacement zone in a bi-directional flow cycle, wherein each of said articulated displacement members has a proximal end portion pivotably mountable on said revolving structure and a distal end portion pivotably securable in said housing at a substantially fixed position, wherein each of said displacement zones has a maximum volume and a minimum volume and said articulated displacement members are operable for cycling said displacement zones to and from said maximum and minimum volumes, and wherein each of said displacement zones is a closed fluid system, and each of said displacement zones is hydraulically isolated from each other displacement zone.

2. The apparatus of claim 1 comprising three of said articulated displacement members defining three of said displacement zones.

3. The apparatus of claim 1 wherein said articulated displacement members are positionable to counteract and substantially eliminate transference of a bending moment to said revolving structure.

4. An apparatus according to claim 1, wherein each of said proximal end portions has a fixed length and each of said distal end portions has a fixed length, and, wherein said lengths of said proximal and said distal end portions are selected to produce at least one particular displacement zone having a cross sectional area and a predetermined duty cycle according to the following equation:

$$A=A_1+A_2-A_3$$

where, A is said cross sectional area of said particular displacement zone, $A_1$ is a first triangular area (402), $A_2$ is a second triangular area (404), and $A_3$ is a third triangular area (406).

5. An apparatus according to claim 1, wherein each of said proximal end portions has a fixed length and each of said distal end portions has a fixed length, and, wherein said lengths of said proximal and said distal end portions are selected to produce at least one particular displacement zone having a cross sectional area and a predetermined duty cycle according to the following equation:

$$A=A_1+A_2+A_3$$

where, A is said cross sectional area of said particular displacement zone, $A_1$ is a first triangular area (412), $A_2$ is a second triangular area (414), and $A_3$ is a third triangular area (416).

6. An apparatus according to claim 1, wherein each of said proximal end portions has a fixed length and each of said distal end portions has a fixed length, and, wherein said lengths of said proximal and said distal end portions are selected to produce at least one particular displacement zone having a cross sectional area and a predetermined duty cycle according to the following equation:

$$A=A_1-A_2-A_3$$

where, A is said cross sectional area of said particular displacement zone, $A_1$ is a first triangular area (422), $A_2$ is a second triangular area (424), and $A_3$ is a third triangular area (426).

7. The apparatus of claim 1 wherein said apparatus is a stirling-type engine.

8. The apparatus of claim 7 further comprising:

a plurality of piston chambers and a plurality of pistons, each of said piston chambers having one of said pistons reciprocatably positionable therein and wherein each of said pistons divides said chamber into two parts and each of said displacement zones is in fluid communication with one said part of a separate one of said piston chambers.

9. The apparatus of claim 8 wherein each of said piston chambers has a displacer reciprocatably positionable therein.

10. The apparatus of claim 9 wherein:

each of said displacement zones is filled with said fluid and said apparatus further comprises cooling means for cooling said fluid.

11. The apparatus of claim 10 wherein each of said piston chambers has an outer end and wherein each said piston chamber has a structure positioned at said outer end thereof for transferring heat to said piston chamber.

12. The apparatus of claim 10 wherein:

said apparatus is operable such that, for each revolution of said revolving structure, each of said piston chambers has a heating phase and a cooling phase.

13. The apparatus of claim 12 wherein said articulated displacement members are configured in a manner such that, in each of said piston chambers, said cooling phase extends over a greater portion of said revolution than does said heating phase.

14. The apparatus of claim 1 wherein each of said articulated displacement members comprises:

a proximal member;

a distal member; and a first hinge pin, wherein said proximal member includes a plurality of closed first hinge rings and a plurality of closed second hinge rings, wherein said distal member includes a plurality of closed third hinge rings, wherein said first hinge rings of said plurality of articulated displacement members are positionable on said revolving structure in an intermeshing manner, and wherein said second and said third hinge rings are mountable on said first hinge pin in an intermeshing manner.

15. The apparatus of claim 14 further comprising friction reducing elements positionable within said first hinge rings for reducing frictional forces generated by movement of said first hinge rings on said revolving structure.

16. The apparatus of claim 15 wherein said friction reducing elements are rolling element bearings.

17. The apparatus of claim 14 wherein each of said articulated displacement members further comprises friction reducing elements positionable within said second and said third hinge rings for reducing frictional forces generated by pivoting said inner and said outer members.

18. The apparatus of claim 17 wherein said friction reducing elements are bushings constructed of plastic alloy impregnated with anti-friction material.

19. The apparatus of claim 14 further comprising:

a second hinge pin, and, wherein said distal member includes a plurality of closed fourth hinge rings, and wherein said housing includes a plurality of closed fifth hinge rings affixed thereto, and, wherein said fourth and said fifth hinge rings are mountable on said second hinge pin in an intermeshing manner.

20. An apparatus for fluid displacement comprising:

a housing having an interior space;

a revolving structure positionable in said interior space for a circuitous, revolving movement;

a plurality of articulated displacement members positionable in said interior space and defining in said interior space a plurality of displacement zones, each said displacement zone having a flow opening through which said fluid alternately both enters and exits said displacement zone in a bi-directional flow cycle, wherein each of said articulated displacement members has a proximal end portion pivotably mountable on said revolving structure and a distal end portion pivotably securable in said housing at a substantially fixed position, wherein each of said displacement zones has a maximum volume and a minimum volume and said articulated displacement members are operable for cycling said displacement zones to and from said maximum and minimum volumes;

a plurality of piston chambers; and, a plurality of pistons, each of said piston chambers having one of said pistons reciprocatably positionable therein and wherein each of said pistons divides said chamber into two parts and each of said displacement zones is in fluid communication with one said part of a separate one of said piston chambers.

21. The apparatus of claim 20 wherein each of said piston chambers has a displacer reciprocatably positionable therein.

22. The apparatus of claim 21 wherein:

each of said displacement zones is filled with said fluid and said apparatus further comprises cooling means for cooling said fluid.

23. The apparatus of claim 22 wherein each of said piston chambers has an outer end and wherein each said piston chamber has a structure positioned at said outer end thereof for transferring heat to said piston chamber.

24. The apparatus of claim 23 wherein:

said apparatus is operable such that, for each revolution of said revolving structure, each of said piston chambers has a heating phase and a cooling phase.

25. The apparatus of claim 24 wherein said articulated displacement members are configured in a manner such that, in each of said piston chambers, said cooling phase extends over a greater portion of said revolution than does said heating phase.

26. An apparatus for fluid displacement comprising:

a housing having an interior space;

a revolving structure positionable in said interior space for a circuitous, revolving movement; and a plurality of articulated displacement members positionable in said interior space and defining in said interior space a plurality of displacement zones, each said displacement zone having a flow opening through which said fluid alternately both enters and exits said displacement zone in a bi-directional flow cycle, wherein each of said articulated displacement members has a proximal end portion pivotably mountable on said revolving structure and a distal end portion pivotably securable in said housing at a substantially fixed position, wherein each of said displacement zones has a maximum volume and a minimum volume and said articulated displacement members are operable for cycling said displacement zones to and from said maximum and minimum volumes, and, wherein each of said displacement zones is a closed fluid system, and each of said displacement zones is hydraulically isolated from each other displacement zone, a proximal pivot point of said articulated displacement members, said proximal pivot point having a center; and, a first mounting post secured to said housing, said first mounting post being for the mounting of a corresponding distal end portion of a first articulated displacement member thereon, said first mounting post having a center;

a second mounting post secured to said housing, said second mounting post being for the mounting of a corresponding distal end portion of a second articulated displacement member thereon, said second mounting post having a center, said second mounting post being adjacent to said first mounting post;

wherein each of said proximal end portions has a fixed length and each of said distal end portions has a fixed length;

wherein said revolving structure has a center;

wherein said lengths of said proximal and distal end portions are selected to produce at least one particular displacement zone having a cross sectional area and a predetermined duty cycle determined according to the following equation:

$$A=A_1+A_2-A_3$$

where, A is said cross sectional area of said particular displacement zone, $A_1$ is a first triangular area, $A_2$ is a second triangular area, and $A_3$ is a third triangular area;

where $A_1$ has three sides of length $D_1$, $D_2$, and $D_3$, respectively and where said $A_1$ side of length $D_1$ and said side of length $D_2$ intersect at said center of said proximal pivot point;

where $A_2$ has three sides of length $L_1$, $L_2$, and $D_2$, respectively, and wherein said $A_2$ side of length $D_2$ is a common side with said $A_1$ side of length $D_2$;

where $A_3$ has three sides of length $L_3$, $L_4$, and $D_1$, respectively, and wherein said $A_3$ side of length $D_1$ is a common side with said $A_1$ side of length $D_1$;

where said length of said proximal end portion is $L_3$;

where said length of said distal end portion is $L_4$;

where, $D_1$ is a distance from said center of said proximal pivot point to said center of said first post;

where $D_2$ is a distance from said center of said proximal pivot point to said center of said second post;

where $D_3$ is a distance from said center of said first mounting post to said center of said second mounting post;

where, $$A_1 = \sqrt{S_1(S_1 - D_1)(S_1 - D_2)(S_1 - D_3)} \cdot [\mathrm{sign}(Y_{CA} - Y_1)],$$

$$A_2 = \sqrt{S_2(S_2 - L_1)(S_2 - L_2)(S_2 - D_2)},$$

and, $$A_3 = \sqrt{S_3(S_3 - L_3)(S_3 - L_4)(S_3 - D_1)};$$

where, $S_1$, $S_2$, and $S_3$, are one-half of a perimeter of said first, second, and third triangular areas respectively, $$S_1=(D_1+D_2+D_3)/2,$$

$$S_2=(L_1+L_2+D_2)/2,$$

$$S_3=(L_3+L_4+D_1)/2;$$

where, $$Y_{CA}=\mathrm{SIN}\ ((180-PA)/2)\cdot R_C;$$

where $R_c$ is a distance between said revolving structure center and said center of said first mounting post; and, where PA is an angle between said center of said first post and said center of said second post as measured from said center of said revolving structure.

* * * * *